US009971304B2

(12) United States Patent
Sakai et al.

(10) Patent No.: US 9,971,304 B2
(45) Date of Patent: May 15, 2018

(54) MOVEMENT AND ELECTRONIC TIMEPIECE

(71) Applicant: SEIKO INSTRUMENTS INC., Chiba-shi Chiba (JP)

(72) Inventors: Satoshi Sakai, Chiba (JP); Katsuya Mugishima, Chiba (JP); Tomohiro Ihashi, Chiba (JP); Kenji Ogasawara, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 0 days. days.

(21) Appl. No.: 15/237,896

(22) Filed: Aug. 16, 2016

(65) Prior Publication Data

US 2017/0052509 A1 Feb. 23, 2017

(30) Foreign Application Priority Data

Aug. 21, 2015 (JP) ..... 2015-163994

(51) Int. Cl.
*G04C 9/00* (2006.01)
*G04C 3/14* (2006.01)
*G04B 19/30* (2006.01)

(52) U.S. Cl.
CPC ..... *G04B 19/30* (2013.01); *G04C 3/14* (2013.01); *G04C 3/146* (2013.01); *G04C 9/00* (2013.01)

(58) Field of Classification Search
CPC ..... G04B 27/00; G04B 27/001; G04C 3/14; G04C 3/146; G04C 9/00; G04G 5/00; G04G 5/002
See application file for complete search history.

(56) References Cited

U.S. PATENT DOCUMENTS 7,154,818 B2 * 12/2006 Liu ..... G04C 3/146 368/187
8,208,348 B2 * 6/2012 Kojima ..... G04C 3/14 368/185

(Continued)

OTHER PUBLICATIONS

Abstract, Publication No. JP 2009-085688, Publication date Apr. 23, 2009.

*Primary Examiner* — Vit W Miska
(74) *Attorney, Agent, or Firm* — Bruce L. Adams

(57) ABSTRACT

A timepiece movement includes a second light emitting element, a second light receiving element, and a second wheel & pinion that drives a second hand and that has a first second wheel transmittable portion and a second second wheel transmittable portion through which light is transmittable, A control unit detects a position of the second wheel & pinion by causing the second light receiving element to receive the transmitted light emitted from the second light emitting element and transmitted through the first second wheel transmittable portion or the second second wheel transmittable portion, and a second detection wheel has a second detection wheel transmittable portion through which the transmitted light is transmittable. The control unit detects a transmitting time point at which the transmitted light is transmitted through the first second wheel transmittable portion or concurrently through the second second wheel transmittable portion and the second detection wheel transmittable portion. After the transmitting time point, when the second detection wheel transmittable portion is located at other positions except for a second detection position where the second detection wheel transmittable portion is located at the transmitting time point, the control unit causes the second light emitting element to stop light emitting.

5 Claims, 13 Drawing Sheets

(56) References Cited

U.S. PATENT DOCUMENTS

| | | | | |
|---|---|---|---|---|
| 2004/0120220 | A1* | 6/2004 | Ogasawara | G04C 3/14 368/80 |
| 2006/0114750 | A1* | 6/2006 | Iida | G04C 3/146 368/67 |
| 2009/0086580 | A1* | 4/2009 | Aoki | G04C 3/14 368/10 |
| 2009/0086581 | A1* | 4/2009 | Suizu | G04C 3/14 368/10 |

* cited by examiner

21 FIRST STEPPING MOTOR
61 FIRST LIGHT EMITTING ELEMENT
64 FIRST LIGHT RECEIVING ELEMENT
18 (16) LIGHT EMITTING CONTROL UNIT
62 SECOND LIGHT EMITTING ELEMENT
65 SECOND LIGHT RECEIVING ELEMENT
19 (16) DETECTION CONTROL UNIT
17 (16) ROTATION CONTROL UNIT
22 SECOND STEPPING MOTOR
63 THIRD LIGHT EMITTING ELEMENT
66 THIRD LIGHT RECEIVING ELEMENT
23 THIRD STEPPING MOTOR

MOVEMENT AND ELECTRONIC TIMEPIECE

BACKGROUND OF THE INVENTION

Field of the Invention

The present invention relates to a movement and an electronic timepiece.

Background Art

In the related art, an electronic timepiece such as a radio timepiece having a hand position detection device mounted thereon is known.

For example, Japanese Patent No. 4998179 discloses a hand position detection device. The hand position detection device includes light transmittable hole portion detection means for identifying each rotation position of a second hand wheel, a minute hand wheel, and an hour hand wheel, and light stopping control means for detecting a light-detected state from a reference hole of the second hand wheel and then causing light emitting means to stop light emitting after a light-undetected state successively occurs a predetermined number of times due to a light-blocking portion, during a period from when the light-detected state is detected from a long hole until the light-detected state is detected from the reference hole of the second hand wheel, or during a period until the next hour.

According to the hand position detection device disclosed in Japanese Patent No. 4998179, whether or not the second hand keeps good time during a normal hand operation can be quickly confirmed a small number of detection times.

SUMMARY OF THE INVENTION

Incidentally, for example, an electronic timepiece including a solar panel has a limited power amount stored in a secondary battery. Accordingly, in order to further lengthen an operating time period of the electronic timepiece, an effective way is to further reduce power consumption. Therefore, the above-described electronic timepiece in the related art needs to reduce the power consumption when a hand position is detected.

Therefore, the present invention aims to provide a movement and an electronic timepiece which can reduce power consumption when a hand position is detected.

According to an aspect of the invention, there is provided a movement including a light emitting element, alight receiving element that is arranged at a position for receiving light emitted from the light emitting element, a gear that is rotated by power of a drive source so as to drive an indicating hand, and that has a transmittable portion through which the light is transmittable, a control unit that detects a position of the gear by causing the light receiving element to receive the light which is emitted from the light emitting element and which is transmitted through the transmittable portion, and a detecting gear that has a transmittable portion for detection through which the light is transmittable, and whose rotational frequency per predetermined time is set to be faster than that of the gear. The control unit detects a transmitting time point that the light is concurrently transmitted through the transmittable portion and the transmittable portion for detection. The control unit causes the light emitting element to stop light emitting, after the transmitting time point, and when the transmittable portion for detection is located at other positions except for a predetermined position where the transmittable portion for detection is located at the transmitting time point.

According to the present invention, the movement includes the control unit that detects the position of the gear by causing the light receiving element to receive the light which is emitted from the light emitting element and which is transmitted through the transmittable portion belonging to the gear. Accordingly, it is possible to detect a position of an indicating hand driven by the gear. Here, the detecting gear has the transmittable portion for detection through which the light transmitted through the transmittable portion of the gear is transmittable. In addition, the control unit causes the light emitting element to stop light emitting, after the transmitting time point that the light is concurrently transmitted through the transmittable portion and the transmittable portion for detection, and when the transmittable portion for detection is located at other positions except for the predetermined position where the transmittable portion for detection is located at the transmitting time point. The transmittable portion for detection cannot transmit the transmitted light, when the transmittable portion for detection is located at other positions except for the predetermined position. Accordingly, the light emitting element can be caused to stop the light emitting without affecting the detection of the position of the gear. Therefore, it is possible to reduce power consumption when the hand position is detected.

In the aspect, the movement may further include a first gear that is rotated by power of a first drive source so as to drive a first indicating hand, a second gear serving as the gear that is arranged coaxially with a center axle of the first gear, and that is rotated by power of a second drive source functioning as the drive source so as to drive a second indicating hand, a first position detecting gear that is arranged so as to overlap a portion of the second gear when viewed in an axial direction of the center axle, and that serves as the detecting gear rotated by power of the second drive source, a first light emitting element and a second light emitting element functioning as the light emitting element, which are arranged on one side in the axial direction with respect to the first gear and the second gear, a first light receiving element that is disposed on the other side in the axial direction across the first gear and the second gear so as to detect the light emitted from the first light emitting element, a second light receiving element functioning as the light receiving element that is disposed on the other side in the axial direction across the first gear and the second gear so as to detect the light emitted from the second light emitting element, and the control unit that controls driving of the first drive source and the second drive source, and that detects the light received by the first light receiving element and the second light receiving element so as to control the light emitting of the first light emitting element and the second light emitting element. The first gear may have a first transmittable portion through which the light emitted from the first light emitting element and the second light emitting element is transmittable, and a second transmittable portion which is disposed on a rotation trajectory of the first transmittable portion, and through which the light emitted from the first light emitting element and the second light emitting element is transmittable. The second gear may have a third transmittable portion and a fourth transmittable portion, which function as the transmittable portion, which are disposed on the rotation trajectory of the first transmittable portion when viewed in the axial direction, through which the light emitted from the first light emitting element and the second light emitting element is transmittable, and which are formed so as to be asymmetric with each other with respect to the center axle. The first position detecting gear may have a fifth transmittable portion functioning as the transmittable portion for detection through which the light emitted from the second light emitting element is transmittable, and is formed so as to be rotated once by causing the second drive source to perform stepwise rotation driving a predetermined number of times. In a first predetermined state where the first gear can transmit the light emitted from the first light emitting element to the first light receiving element in the first transmittable portion, the second light receiving element may be disposed so as to be capable of detecting the light transmitted through the second transmittable portion and emitted from the second light emitting element. The fifth transmittable portion may be disposed to be located at a position corresponding to the fourth transmittable portion, when the fourth transmittable portion is located at a position corresponding to the second transmittable portion of the first gear in the first predetermined state, when viewed in the axial direction. In the first predetermined state, the control unit may cause the second light emitting element to emit the light, and performs a fifth transmittable portion searching step of driving the second drive source until the second light receiving element receives the light emitted from the second light emitting element. In a case where the control unit determines that the second light receiving element receives the light emitted from the second light emitting element in the fifth transmittable portion searching step, when the control unit drives the second drive source, the control unit may cause the second drive source to perform stepwise rotation driving per predetermined number of times, and the control unit may cause the first light emitting element and the second light emitting element to stop light emitting while the second drive source is driven.

In the aspect, the first transmittable portion and the second transmittable portion are disposed in the first gear. The third transmittable portion and the fourth transmittable portion are disposed in the second gear arranged coaxially with the center axle of the first gear. When the rotation position of the second gear is detected in order to detect the position of the second indicating hand, the position of the fourth transmittable portion disposed in the second gear is detected. In this case, while the second gear is rotated, the first light receiving element or the second light receiving element is caused to detect the light emitted from the first light emitting element or the second light emitting element after being transmitted through the first transmittable portion or the second transmittable portion of the first gear and the third transmittable portion or the fourth transmittable portion of the second gear.

In the aspect, the third transmittable portion and the fourth transmittable portion are formed so as to be asymmetric with each other with respect to the center axle. Accordingly, the first light receiving element or the second light receiving element is caused to detect a light transmitted pattern corresponding to a shape, a position, and the number of the third transmittable portion and the fourth transmittable portion. Therefore, it is possible to identify the fourth transmittable portion in a state of distinguishing the fourth transmittable portion from the third transmittable portion. In this manner, it is possible to detect the rotation position of the second gear.

Moreover, in the aspect, in the first predetermined state where the first gear can transmit the light emitted from the first light emitting element to the first light receiving element in the first transmittable portion, the light emitted from the second light emitting element is transmitted through the second transmittable portion of the first gear, and can be detected by the second light receiving element. Accordingly, the first gear is brought into the first predetermined state in order to detect the position of the fourth transmittable portion disposed in the second gear. Therefore, both the first light emitting element and the first light receiving element, and both the second light emitting element and the second light receiving element can be used in detecting the position of the fourth transmittable portion. In this manner, the rotation position of the second gear is detected by detecting the position of the fourth transmittable portion in any one of the first light receiving element and the second light receiving element. Accordingly, compared to a case where the position of the fourth transmittable portion is detected by one light receiving element, it is possible to shorten a time required for detecting the position of the fourth transmittable portion. Therefore, it is possible to shorten a time for operating the first light emitting element and the second light emitting element, and thus, it is possible to reduce power consumption when the hand position is detected.

In the aspect, the movement further includes the first position detecting gear formed so as to be rotated once by causing the second drive source to perform the stepwise rotation driving a predetermined number of times. The first position detecting gear has the fifth transmittable portion located at the position corresponding to the fourth transmittable portion when the fourth transmittable portion is located at the position corresponding to the second transmittable portion of the first gear in the first predetermined state, when viewed in the axial direction. Accordingly, in a state where the first position detecting gear is rotated and the fifth transmittable portion is located at other positions except for the position corresponding to the second transmittable portion of the first gear, the first position detecting gear blocks the light emitted from the second light emitting element.

In the aspect, the control unit performs the fifth transmittable portion searching step of causing the second light emitting element to emit the light in the first predetermined state, and driving the second drive source until the second light receiving element receives the light emitted from the second light emitting element. Accordingly, it is possible to detect a state where the fifth transmittable portion is located at the position corresponding to the second transmittable portion of the first gear. Then, in the fifth transmittable portion searching step, in a case where the control unit determines that the second light receiving element receives the light emitted from the second light emitting element, when driving the second drive source, the control unit causes the second drive source to perform the stepwise rotation driving per predetermined number of times. While the second drive source is driven, the control unit causes the first light emitting element and the second light emitting element to stop light emitting. Accordingly, the control unit can cause the second light emitting element to stop light emitting in a state where the second light receiving element cannot detect the light after the fifth transmittable portion is located at other positions except for the position corresponding to the second transmittable portion of the first gear and blocks the light emitted from the second light emitting element. Therefore, it is possible to reduce power consumption when the hand position is detected.

In the aspect, the movement may further include a second position detecting gear that is arranged between the first light emitting element and the first light receiving element in the axial direction, and that is rotated by power of the first drive source. The second position detecting gear may have a sixth transmittable portion through which the light emitted from the first light emitting element is transmittable. In the first predetermined state, the sixth transmittable portion may be disposed so as to be located at a position corresponding to the first transmittable portion when viewed in the axial direction, and in a second predetermined state where the first gear can transmit the light emitted from the first light emitting element to the first light receiving element in the second transmittable portion, the sixth transmittable portion may be disposed so as to be located at a position corresponding to the second transmittable portion when viewed in the axial direction.

When the rotation position of the first gear is detected in order to detect the position of the first indicating hand, for example, while the first gear is rotated, the first light receiving element is caused to detect the light emitted from the first light emitting element after being transmitted through the first transmittable portion or the second transmittable portion and the third transmittable portion or the fourth transmittable portion. Depending on a rotation angle of the first gear for one step of the first drive source, in order to cause the first transmittable portion or the second transmittable portion located at a corresponding position (hereinafter, referred to as a "first detection position" between the first light emitting element and the first light receiving element to completely retreat from the first detection position, it is necessary to rotate the first drive source several steps in some cases.

In the aspect, the sixth transmittable portion belonging to the second position detecting gear is disposed at the position corresponding to the first transmittable portion when viewed in the axial direction, in the first predetermined state where the first gear can transmit the light emitted from the first light emitting element to the first light receiving element in the first transmittable portion. In addition, the sixth transmittable portion is disposed at the position corresponding to the second transmittable portion when viewed in the axial direction, in the second predetermined state where the first gear can transmit the light emitted from the first light emitting element to the first light receiving element in the second transmittable portion. The rotation angle of the second position detecting gear for one step of the first drive source can become larger than the rotation angle of the first gear by setting a gear ratio of the first gear with respect to the second position detecting gear to be smaller than one. In this manner, the sixth transmittable portion located at the first detection position can be caused to completely retreat from the first detection position by rotating the first drive source one step. Accordingly, even in a case where it is necessary to rotate the first drive source several steps in order to cause the first transmittable portion or the second transmittable portion located at the first detection position to completely retreat from the first detection position, it is possible to block the light emitted from the first light emitting element in a region other than the sixth transmittable portion of the second position detecting gear. Accordingly, one step of the first drive source enables the first light receiving element to be shifted between a state where the light emitted from the first light emitting element can be detected and a state where the light cannot be detected. Therefore, it is possible to reliably detect the rotation position of the first gear in response to the position detection of the first indicating hand.

In the aspect, a pair of the third transmittable portions may be disposed so as to be symmetric with each other with respect to the center axle. The control unit may perform a first determination step of determining whether or not any one of the first light receiving element and the second light receiving element detects a first pattern indicating that the third transmittable portion passes through a position corresponding to the second transmittable portion when viewed in the axial direction, in a case where the control unit determines that the second light receiving element receives the light emitted from the second light emitting element in the fifth transmittable portion searching step, a second determination step of determining whether or not the second light receiving element detects the first pattern, in a case where the control unit determines that any one of the first light receiving element and the second light receiving element detects the first pattern in the first determination step, a third determination step of causing the second drive source to perform the stepwise rotation driving at least a predetermined number of times in a case where the control unit determines that the second light receiving element detects the first pattern in the second determination step, and determining whether or not the second light receiving element detects a second pattern indicating that the fourth transmittable portion passes through a position corresponding to the second transmittable portion when viewed in the axial direction, and a fourth determination step of causing the second drive source to perform the stepwise rotation driving at least a predetermined number of times in a case where the control unit determines that the second light receiving element does not detect the first pattern in the second determination step, and determining whether or not the first light receiving element detects the second pattern.

In the aspect, a pair of the third transmittable portions are disposed so as to be symmetric with each other with respect to the center axle. Accordingly, the fourth transmittable portion is disposed in one region within regions between a pair of the third transmittable portions in the circumferential direction of the second gear. Therefore, after the control unit determines that any one of the first light receiving element and the second light receiving element detects the first pattern indicating that the third transmittable portion passes in the first determination step and the second determination step, the control unit determines whether or not the light receiving element detecting the first pattern detects the second pattern indicating that the fourth transmittable portion passes in the third determination step or the fourth determination step. In this manner, the first light receiving element or the second light receiving element does not need to directly detect the light transmitted through the fourth transmittable portion, and the position of the fourth transmittable portion can be detected. Accordingly, it is possible to efficiently detect the position of the fourth transmittable portion. Therefore, it is possible to shorten a time for operating the first light emitting element and the second light emitting element, and thus, it is possible to reduce power consumption when the hand position is detected.

According to another aspect of the invention, there is provided an electronic timepiece including the movement and a solar panel that generates power to be supplied to the drive source.

In the aspect, since the movement is provided, it is possible to reduce power consumption when the hand position is detected. Therefore, the invention is preferably applicable to the electronic timepiece including the solar panel.

According to an aspect of the invention, it is possible to reduce power consumption when the hand position is detected.

DETAILED DESCRIPTION OF THE INVENTION

Hereinafter, an embodiment according to the present invention will be described with reference to the drawings.

In general, a mechanical body including a drive portion of a timepiece is called a "movement". The timepiece in a finished state where the movement is accommodated in a timepiece case by attaching a dial and indicating hands to the movement is referred to as a "complete assembly".

A side having glass of the timepiece case in both sides of a main plate configuring a substrate of the timepiece, that is, a side having a dial is referred to as a "rear side". In addition, a side having a case rear cover of the timepiece case in both sides of the main plate, that is, a side opposite to the dial is referred to as a "front side".

Electronic Timepiece

Figure 1:
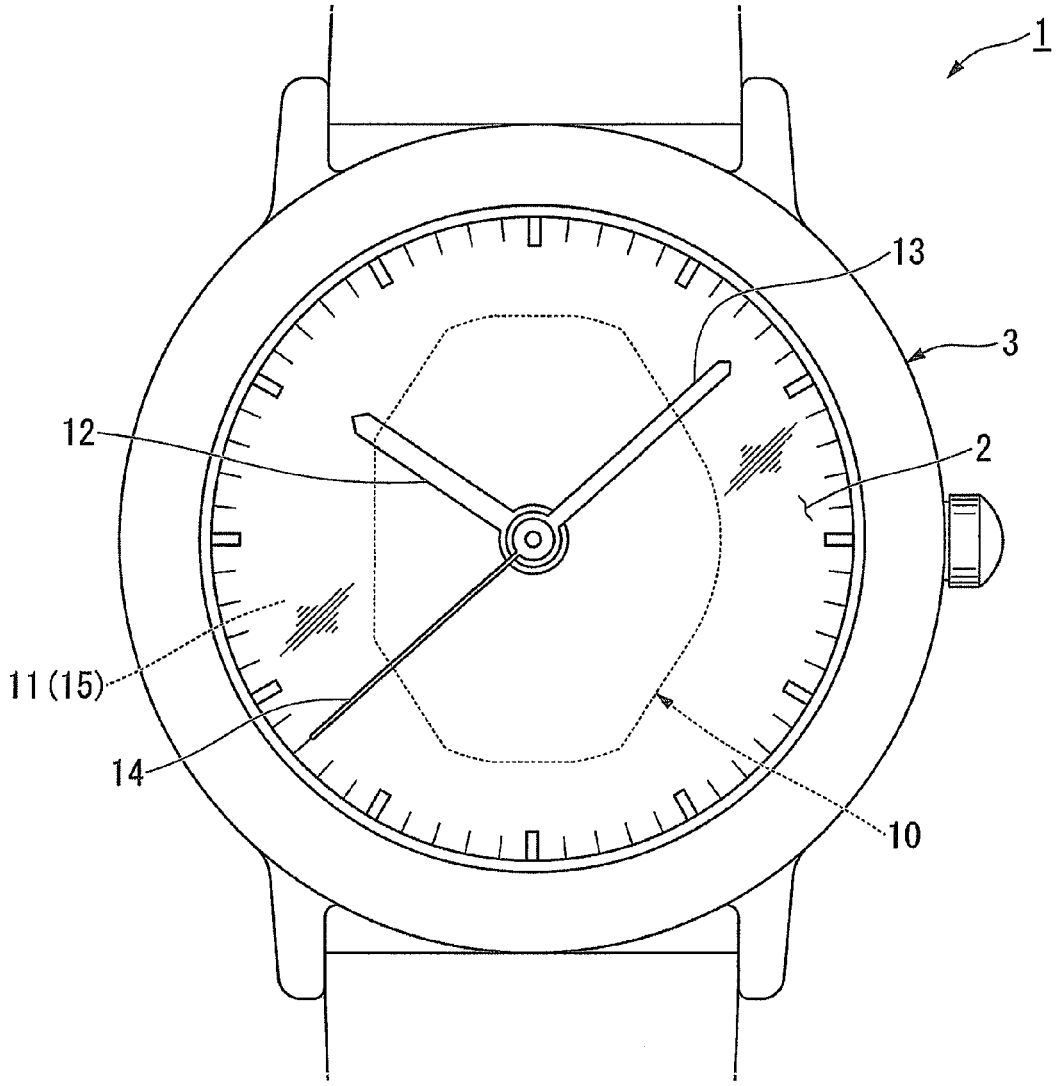
FIG. 1 is an external view illustrating an electronic timepiece according to an embodiment.

FIG. 1 is an external view of an electric timepiece according to an embodiment.

As illustrated in FIG. 1, an electronic timepiece 1 according to the present embodiment is an analog timepiece of multi-Hz drive (4 Hz drive in the present embodiment) in which a second hand 14 is driven multiple times per second. In other words, the electronic timepiece 1 relates to an analog timepiece which employs a drive system in which the second hand is operated one second by receiving a drive pulse from a stepping motor as many as multiple steps. The complete assembly of the electronic timepiece 1 includes a movement 10, a dial 11, and indicating hands 12, 13, and 14 inside a timepiece case 3 having the case rear cover (not illustrated) and glass 2.

The dial 11 is formed integrally with a solar panel 15, and has a scale indicating information relating to at least the hour. The solar panel 15 generates power to be supplied to respective stepping motors 21, 22, and 23 (refer to FIG. 2) via a control unit 16 (refer to FIG. 3) (to be described later). The indicating hands 12, 13, and 14 include the hour hand 12 indicating the hour, the minute hand 13 (first indicating hand) indicating the minute, and the second hand 14 (indicating hand, second indicating hand) indicating the second. The dial 11, the hour hand 12, the minute hand 13, and the secondhand 14 are arranged so as to be visible through the glass 2.

Movement

Figure 2:
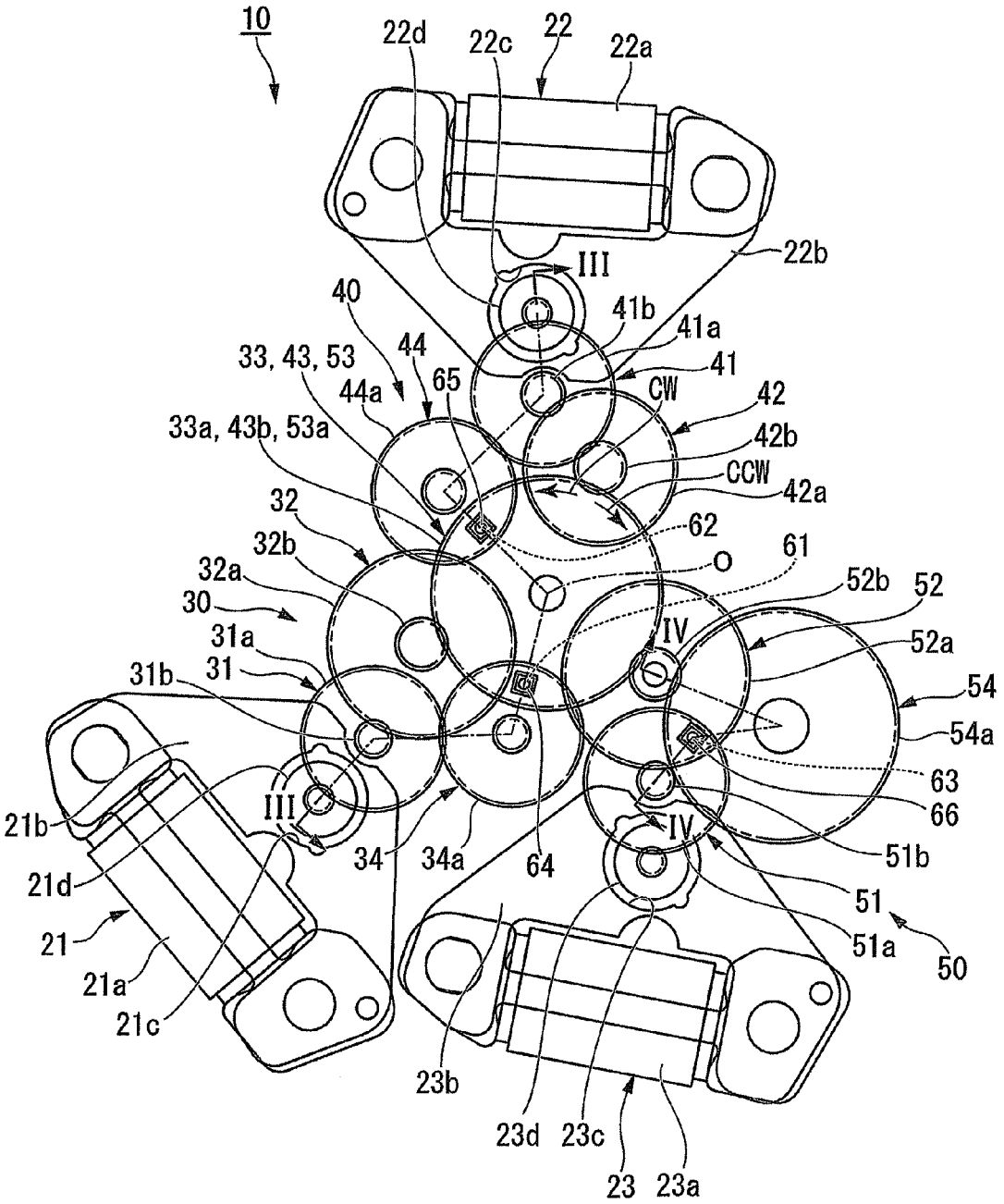
FIG. 2 is a plan view when a movement is viewed from a front side.
Figure 3:
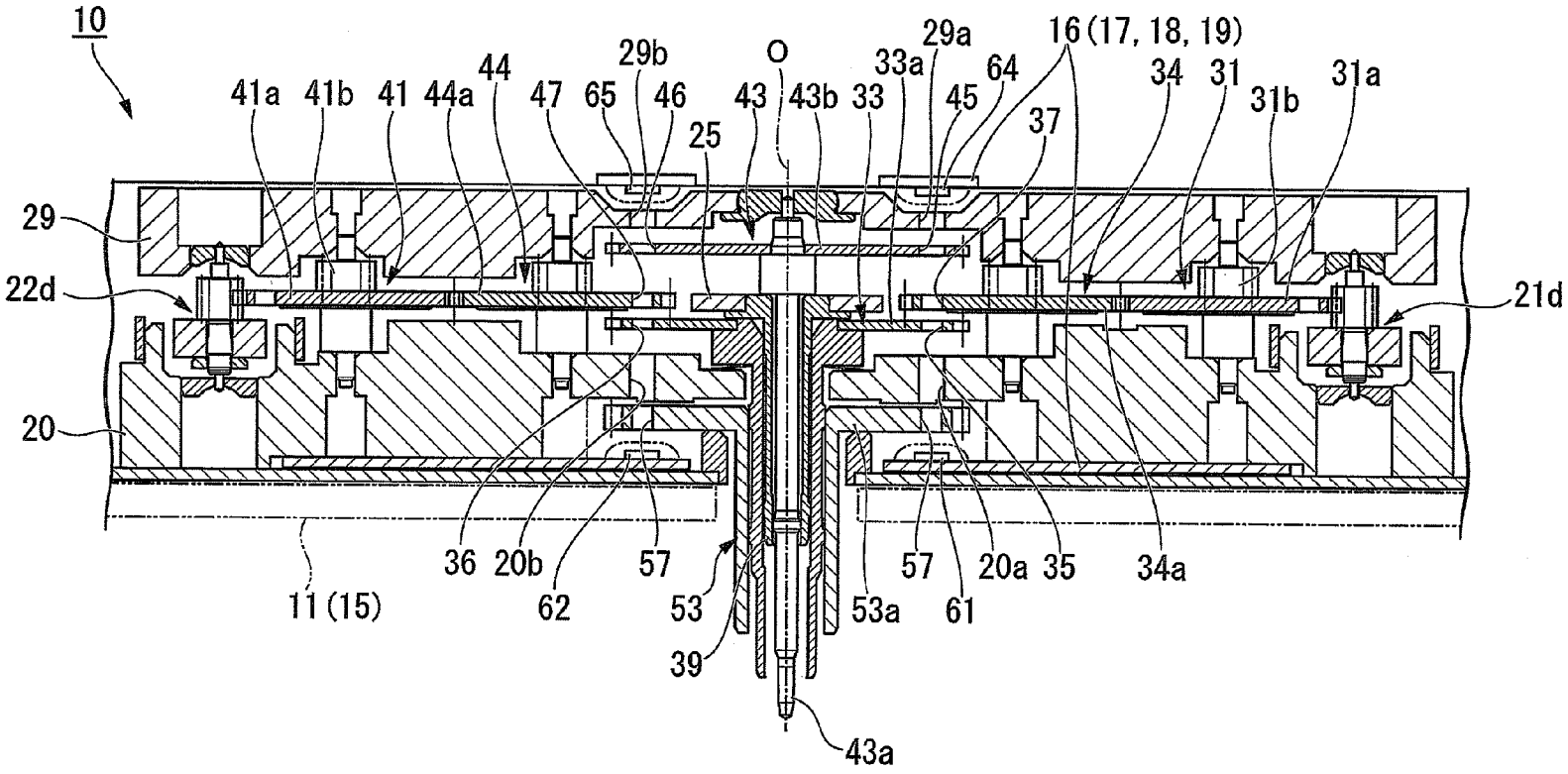
FIG. 3 is a sectional view taken along line III-III in FIG. 2.
Figure 4:
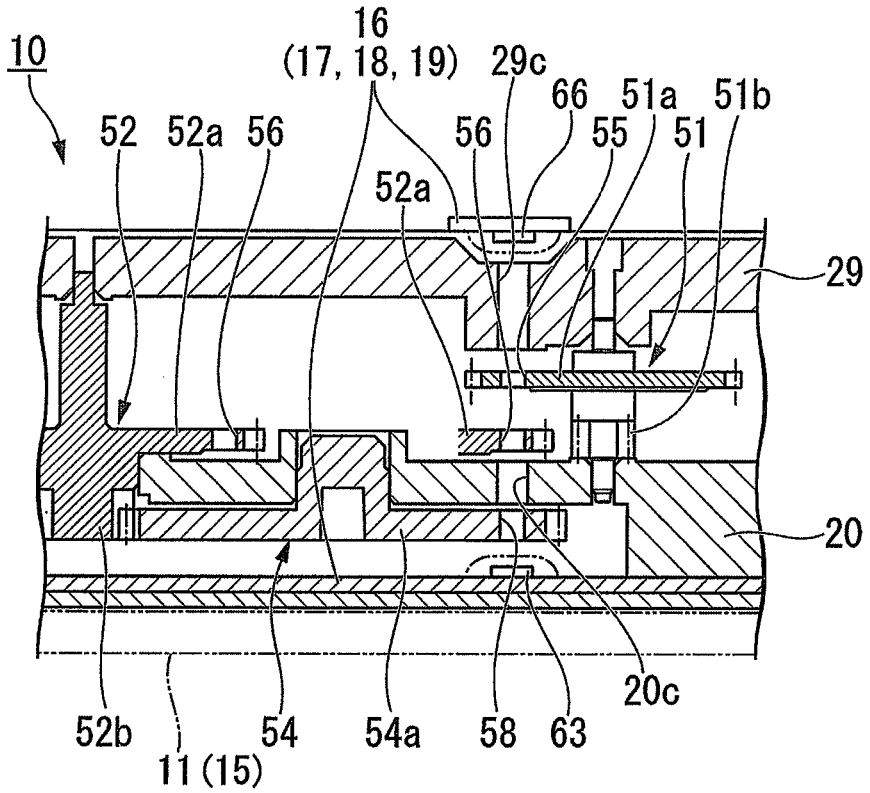
FIG. 4 is a sectional view taken along line IV-IV in FIG. 2.

FIG. 2 is a plan view when the movement is viewed from the front side. FIG. 3 is a sectional view taken along line III-III in FIG. 2. FIG. 4 is a sectional view taken along line IV-IV in FIG. 2.

As illustrated in FIGS. 2 to 4, the movement 10 mainly includes a secondary battery (not illustrated), the control unit 16, a main plate 20, a train wheel bridge 29, the first stepping motor 21 (first drive source), the second stepping motor 22 (drive source, second drive source), the third stepping motor 23, a first train wheel 30, a second train wheel 40, a third train wheel 50, a first light emitting element 61, a second light emitting element 62 (light emitting element), a third light emitting element 63, a first light receiving element 64, a second light receiving element 65, and a third light receiving element 66.

The secondary battery (not illustrated) is charged with power supplied from the solar panel 15, and supplies the power to the control unit 16.

The control unit 16 is a circuit board, and has an integrated circuit mounted thereon. For example, the integrated circuit is configured to include C-MOS or PLA. The control unit 16 includes a rotation control unit 17 for controlling the respective stepping motors 21, 22, and 23, a light emitting control unit 18 for controlling the respective light emitting elements 61, 62, and 63, and a detection control unit 19 for detecting light received by the respective light receiving elements 64, 65, and 66.

The main plate 20 configures the substrate of the movement 10. The dial 11 is arranged on the rear side of the main plate 20.

The train wheel bridge 29 is arranged on the front side of the main plate 20.

As illustrated in FIG. 2, the respective stepping motors 21, 22, and 23 have coil blocks 21*a*, 22*a*, and 23*a* including a coil wire wound around a magnetic core, stators 21*b*, 22*b*, and 23*b* arranged so as to come into contact with both end portions of the magnetic core of the coil blocks 21*a*, 22*a*, and 23*a*, and rotors 21*d*, 22*d*, and 23*d* arranged in rotor holes 21*c*, 22*c*, and 23*c* of the stators 21*b*, 22*b*, and 23*b*. As illustrated in FIGS. 3 and 4, the respective rotors 21*d*, 22*d*, and 23*d* are rotatably supported by the main plate 20 and the train wheel bridge 29. The respective stepping motors 21, 22, and 23 are connected to the rotation control unit 17.

As illustrated in FIG. 2, the first train wheel 30 has a center wheel & pinion 33 (the first gear) which is rotated by the power of the first stepping motor 21 so as to drive the minute hand 13, a first center intermediate wheel 31 and a second center intermediate wheel 32 which transmit the power of the first stepping motor 21 to the center wheel & pinion 33, and a minute detection wheel 34 (second position detecting gear) which is rotated by the power of the first stepping motor 21.

The first center intermediate wheel 31 has a first center intermediate gear 31*a* and a first center intermediate pinion 31*b*, and is rotatably supported by the main plate 20 and the train wheel bridge 29 (refer to FIG. 3). The first center intermediate gear 31*a* meshes with a pinion of the rotor 21*d* of the first stepping motor 21.

The second center intermediate wheel 32 has a second center intermediate gear 32*a* and a second center intermediate pinion 32*b*, and is rotatably supported by the main plate 20 and the train wheel bridge 29. The second center intermediate gear 32*a* meshes with the first center intermediate pinion 31*b* of the first center intermediate wheel 31.

As illustrated in FIG. 3, the center wheel & pinion 33 is externally and rotatably inserted into a central pipe 39. The central pipe 39 is held in a central wheel bridge 25 fixed to the main plate 20. In the following description, the extending direction of the center axle O of the center wheel & pinion 33 is referred to as the axial direction, the train wheel bridge 29 side (front side) along the axial direction is referred to as an upper side, and the main plate 20 side (rear side) is referred to as a lower side. In addition, as illustrated in FIG. 2, an arrow CW in the drawing indicates a direction turning clockwise around the center axle O when the movement 10 is viewed from below, and an arrow CCW indicates a direction turning counterclockwise around the center axle O when the movement 10 is viewed from below.

As illustrated in FIG. 2, the center wheel & pinion 33 has a center gear 33*a* which meshes with the second center intermediate pinion 32*b* of the second center intermediate wheel 32. For example, the center wheel & pinion 33 is configured to be rotated once if the first stepping motor 21 is rotated 360 steps. The rotation angle of the center wheel & pinion 33 which corresponds to one step of the first stepping motor 21 is set to 1°. The minute hand 13 is attached to a lower end portion of the center wheel & pinion 33.

Figure 5:
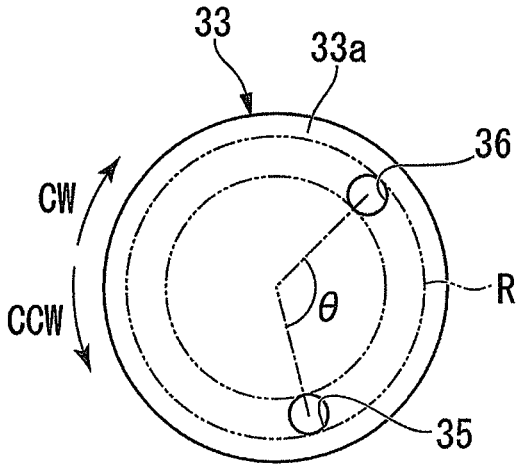
FIG. 5 is a plan view of a center wheel & pinion.

FIG. 5 is a plan view of the center wheel & pinion.

As illustrated in FIG. 5, the center wheel & pinion 33 has a first center wheel transmittable portion 35 (first transmittable portion) through which light is transmittable and a second center wheel transmittable portion 36 (second transmittable portion) through which the light is transmittable. The first center wheel transmittable portion 35 and the second center wheel transmittable portion 36 are circular through-holes formed in the same shape, for example. The second center wheel transmittable portion 36 is disposed on a rotation trajectory of the first center wheel transmittable portion 35. The term of "rotation trajectory" described herein represents a region R through which the first center wheel transmittable portion 35 passes when the center wheel & pinion 33 is rotated (similar in the following description). A central angle θ between the first center wheel transmittable portion 35 and the second center wheel transmittable portion 36 is set to 120°, for example. A portion between the first center wheel transmittable portion 35 and the second center wheel transmittable portion 36 represents a portion corresponding to a side where a separated distance is shorter between the first center wheel transmittable portion 35 and the second center wheel transmittable portion 36 in the circumferential direction of the center wheel & pinion 33. In addition, in this manner, the central angle θ becomes smaller than 180°. The second center wheel transmittable portion 36 is disposed at a position where the second center wheel transmittable portion 36 is rotated by the angle θ in the direction CCW with respect to the first center wheel transmittable portion 35.

As illustrated in FIG. 3, the minute detection wheel 34 is rotatably supported by the main plate 20 and the train wheel bridge 29. As illustrated in FIG. 2, the minute detection wheel 34 is arranged so as to partially overlap the center wheel & pinion 33 when viewed in the axial direction. The minute detection wheel 34 has a minute detection gear 34*a*. The minute detection gear 34*a* meshes with the first center intermediate gear 31*a* of the first center intermediate wheel 31. For example, if the first stepping motor 21 is rotated 12 steps, the minute detection wheel 34 is configured to be rotated once. The rotation angle of the minute detection wheel 34 which corresponds to one step of the first stepping motor 21 is set to 30°. If the minute detection wheel 34 is rotated 30 times, the center wheel & pinion 33 is rotated once.

Figure 6:
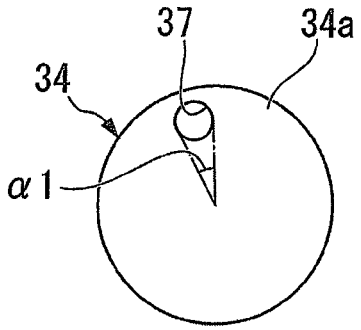
FIG. 6 is a plan view of a minute detection wheel.

FIG. 6 is a plan view of the minute detection wheel.

As illustrated in FIG. 6, the minute detection wheel 34 has a minute detection wheel transmittable portion 37 (sixth transmittable portion) through which the light is transmittable. The minute detection wheel transmittable portion 37 is a circular through-hole, for example. A central angle α1 corresponding to a portion between a pair of tangent lines passing through the rotation center of the minute detection wheel 34 in the tangent line of the minute detection wheel transmittable portion 37 in a plan view is set to be smaller than the rotation angle of the minute detection wheel 34 which corresponds to one step of the first stepping motor 21, for example.

As illustrated in FIG. 2, the second train wheel 40 has a second wheel & pinion 43 (gear, second gear) which is rotated by the power of the second stepping motor 22 so as to drive the secondhand 14, a sixth wheel 41 and a fifth wheel 42 which transmit the power of the second stepping motor 22 to the second wheel & pinion 43, and a second detection wheel 44 (the detecting gear, first position detecting gear) which is rotated by the power of the first stepping motor 21.

The sixth wheel 41 has a sixth gear 41*a* and a sixth wheel pinion 41*b*, and is rotatably supported by the main plate 20 and the train wheel bridge 29 (refer to FIG. 3). The sixth gear 41*a* meshes with a pinion of the rotor 22*d* of the second stepping motor 22.

The fifth wheel 42 has a fifth gear 42*a* and a fifth wheel pinion 42*b*, and is rotatably supported by the main plate 20 and the train wheel bridge 29. The fifth gear 42*a* meshes with the sixth wheel pinion 41*b* of the sixth wheel 41.

The second wheel & pinion 43 is arranged coaxially with the center axle O. As illustrated in FIG. 3, the second wheel & pinion 43 has a wheel axle 43*a* and a second gear 43*b* fixed to the wheel axle 43*a*. The wheel axle 43*a* is rotatably inserted into the central pipe 39. The second hand 14 is attached to a lower end portion of the wheel axle 43*a*. As illustrated in FIG. 2, the second gear 43*b* meshes with the fifth wheel pinion 42*b* of the fifth wheel 42. For example, if the second stepping motor 22 is rotated 240 steps, the second wheel & pinion 43 is configured to be rotated once. The rotation angle of the second wheel & pinion 43 which corresponds to one step of the second stepping motor 22 is set to 1.5°.

Figure 7:
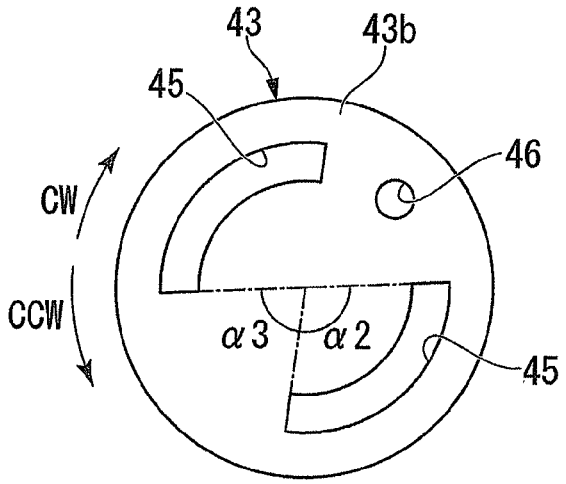
FIG. 7 is a plan view of a second wheel & pinion.

FIG. 7 is a plan view of the second wheel & pinion.

As illustrated in FIG. 7, the second wheel & pinion 43 has a pair of first second wheel transmittable portions 45 (transmittable portion, third transmittable portion) through which the light is transmittable and a second second wheel transmittable portion 46 (transmittable portion, fourth transmittable portion) through which the light is transmittable.

A pair of the first second wheel transmittable portions 45 are disposed on the rotation trajectory of the first center wheel transmittable portion 35 of the center wheel & pinion 33 when viewed in the axial direction. A pair of the first second wheel transmittable portions 45 respectively form long holes extending along the circumferential direction of the second wheel & pinion 43. A pair of the first second wheel transmittable portions 45 are symmetric with each other with respect to the center axle O. The dimension of the respective first second wheel transmittable portions 45 along the circumferential direction of the second wheel & pinion 43 is set to the dimension which is equal to or larger than the separated distance between end portions of a pair of the first second wheel transmittable portions 45 along the circumferential direction of the second wheel & pinion 43. A central angle α2 formed by both end portions of the respective first second wheel transmittable portions 45 is set to be equal to or larger than a central angle α3 between a pair of the first second wheel transmittable portions 45 along the circumferential direction of the second wheel & pinion 43. In the present embodiment, the central angle α2 is set to 100°. In addition, the central angle α3 is set to 80°.

The second second wheel transmittable portion 46 is disposed on the rotation trajectory of the first second wheel transmittable portion 45. For example, the second second wheel transmittable portion 46 is a circular through-hole having the same inner diameter as the width dimension of the first second wheel transmittable portion 45. The second second wheel transmittable portion 46 is disposed on the rotation trajectory of the first second wheel transmittable portion 45, at an intermediate position between a pair of the first second wheel transmittable portions 45.

As illustrated in FIG. 3, the second detection wheel 44 is rotatably supported by the main plate 20 and the train wheel bridge 29. As illustrated in FIG. 2, the second detection wheel 44 is arranged so as to partially overlap the second wheel & pinion 43 when viewed in the axial direction. The second detection wheel 44 has a second detection gear 44*a*. The second detection gear 44*a* meshes with the sixth gear 41*a* of the sixth wheel 41. The second detection wheel 44 is configured to be rotated once if the second stepping motor 22 is rotatably driven a predetermined number of times N (10 steps in the present embodiment). In the second detection wheel 44, rotational frequency per predetermined time is set to faster than that of the second wheel & pinion 43. Specifically, the rotation angle of the second detection wheel 44 which corresponds to one step of the second stepping motor 22 is set to 36°. If the second detection wheel 44 is rotated 24 times, the second wheel & pinion 43 is rotated once.

Figure 8:
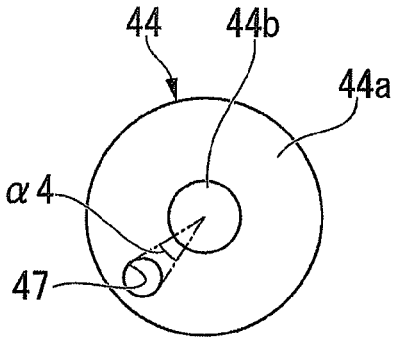
FIG. 8 is a plan view of a second detection wheel.

FIG. 8 is a plan view of the second detection wheel.

As illustrated in FIG. 8, the second detection wheel 44 has a second detection wheel transmittable portion 47 (transmittable portion for detection, fifth transmittable portion) through which the light is transmittable. The second detection wheel transmittable portion 47 is a circular through-hole, for example. A central angle α4 corresponding to a portion between a pair of tangent lines passing through the rotation center of the second detection wheel 44 in the tangent line of the second detection wheel transmittable portion 47 in a plan view is set to be smaller than the rotation angle of the second detection wheel 44 which corresponds to one step of the second stepping motor 22, for example.

As illustrated in FIG. 2, the third train wheel 50 has an intermediate minute wheel 51, a minute wheel 52, an hour wheel 53, and an hour detection wheel 54.

The intermediate minute wheel 51 has an intermediate minute gear 51*a* and an intermediate minute wheel pinion 51*b*, and is rotatably supported by the main plate 20 and the train wheel bridge 29 (refer to FIG. 4). The intermediate minute gear 51*a* meshes with a pinion of the rotor 23*d* of the third stepping motor 23.

Figure 9:
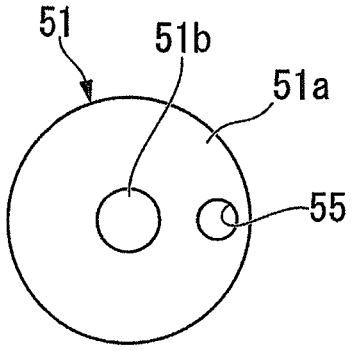
FIG. 9 is a plan view of an intermediate minute wheel.

FIG. 9 is a plan view of the intermediate minute wheel.

As illustrated in FIG. 9, the intermediate minute wheel 51 has an intermediate minute wheel transmittable portion 55 through which the light is transmittable. The intermediate minute wheel transmittable portion 55 is a circular through-hole.

As illustrated in FIG. 4, the minute wheel 52 is rotatably supported by the main plate 20 and the train wheel bridge 29. As illustrated in FIG. 2, the minute wheel 52 has a minute gear 52*a* and a minute wheel pinion 52*b*. The minute gear 52*a* meshes with the intermediate minute wheel pinion 51*b*. The minute gear 52*a* is arranged so as to overlap a portion of the intermediate minute gear 51*a* of the intermediate minute wheel 51 when viewed in the axial direction.

Figure 10:
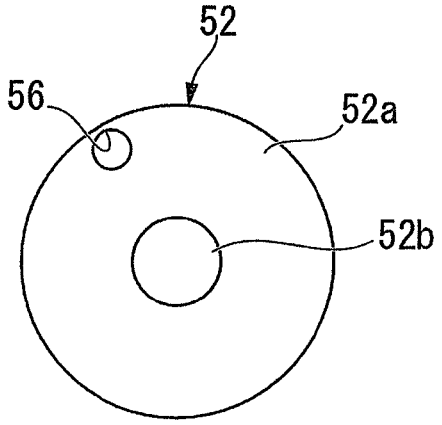
FIG. 10 is a plan view of a minute wheel.

FIG. 10 is a plan view of the minute wheel.

As illustrated in FIG. 10, the minute wheel 52 has a minute wheel transmittable portion 56 through which the light is transmittable. For example, the minute wheel transmittable portion 56 is formed in the same shape as the intermediate minute wheel transmittable portion 55 of the intermediate minute wheel 51 (refer to FIG. 9).

As illustrated in FIG. 3, the hour wheel 53 is arranged coaxially with the center axle O, and is rotatably and externally inserted into the center wheel & pinion 33. As illustrated in FIG. 2, the hour wheel 53 has an hour gear 53*a* which meshes with the minute wheel pinion 52*b* of the minute wheel 52. The hour hand 12 is attached to a lower end portion of the hour wheel 53.

Figure 11:
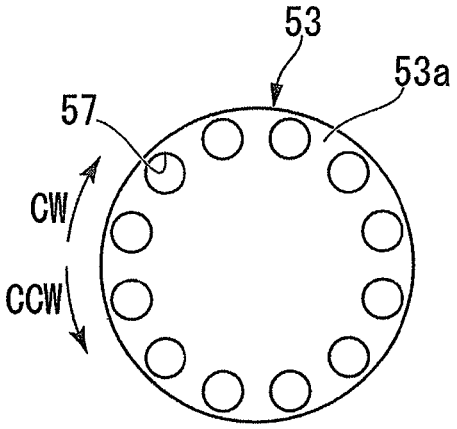
FIG. 11 is a plan view of an hour wheel.

FIG. 11 is a plan view of the hour wheel.

As illustrated in FIG. 11, the hour wheel 53 has 12 hour wheel transmittable portions 57 through which the light is transmittable. The 12 hour wheel transmittable portions 57 are circular through-holes, and are arrayed at equal intervals (interval of 30° in the present embodiment) along the circumferential direction of the hour wheel 53. The respective hour wheel transmittable portions 57 are disposed on the rotation trajectory of the first center wheel transmittable portion 35 of the center wheel & pinion 33 when viewed in the axial direction.

As illustrated in FIG. 4, the hour detection wheel 54 is rotatably supported by the main plate 20. As illustrated in FIG. 2, the hour detection wheel 54 is arranged so as to partially overlap a portion where the intermediate minute gear 51*a* of the intermediate minute wheel 51 overlaps the minute gear 52*a* of the minute wheel 52 when viewed in the axial direction. The hour detection wheel 54 has an hour detection gear 54*a*. The hour detection gear 54*a* meshes with the minute wheel pinion 52*b* of the minute wheel 52.

Figure 12:
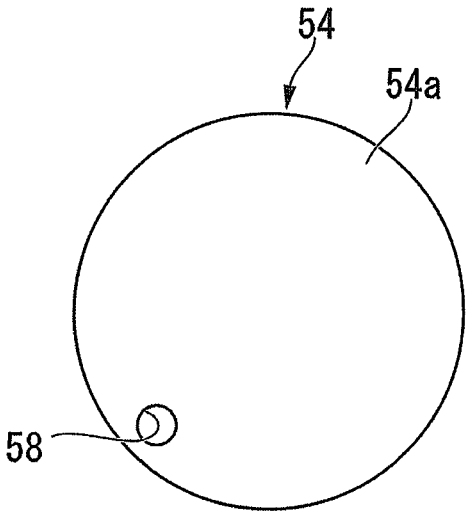
FIG. 12 is a plan view of an hour detection wheel.

FIG. 12 is a plan view of the hour detection wheel.

As illustrated in FIG. 12, the hour detection wheel 54 has an hour detection wheel transmittable portion 58 through which the light is transmittable. For example, the hour detection wheel transmittable portion 58 is formed in the same shape as the intermediate minute wheel transmittable portion 55 of the intermediate minute wheel 51 (refer to FIG. 9).

As illustrated in FIGS. 2 and 3, the first light emitting element 61 is arranged on the lower side in the axial direction with respect to the center wheel & pinion 33 and the second wheel & pinion 43, and is fixed to the main plate 20, for example. For example, the first light emitting element 61 is a light emitting diode (LED) or a laser diode (LD), and can emit the light upward. The first light emitting element 61 is connected to the light emitting control unit 18.

The first light receiving element 64 is arranged at a position for receiving the light emitted from the first light emitting element 61. The first light receiving element 64 is arranged on the upper side in the axial direction, across the center wheel & pinion 33 and the second wheel & pinion 43, and is fixed to the train wheel bridge 29, for example. For example, the first light receiving element 64 is a photo diode, and detects the light emitted from the first light emitting element 61. The first light receiving element 64 is connected to the detection control unit 19.

Through-holes 20*a* and 29*a* respectively penetrating the main plate 20 and the train wheel bridge 29 in the axial direction are formed at a position corresponding to a portion between the first light emitting element 61 and the first light receiving element 64 (hereinafter, referred to as a "first detection position"). The light emitted from the first light emitting element 61 is incident on the first light receiving element 64 after passing through the through-holes 29*a* and 20*a*.

The center wheel & pinion 33, the minute detection wheel 34, the second wheel & pinion 43, and the hour wheel 53 are arranged at the first detection position. The first detection position overlaps the rotation trajectory of the first center wheel transmittable portion 35 and the second center wheel transmittable portion 36 of the center wheel & pinion 33 when viewed in the axial direction. In this manner, the first detection position overlaps the rotation trajectory of the first second wheel transmittable portion 45 and the second second wheel transmittable portion 46 of the second wheel & pinion 43 and the rotation trajectory of the hour wheel transmittable portion 57 of the hour wheel 53 when viewed in the axial direction. In addition, the first detection position overlaps the rotation trajectory of the minute detection wheel transmittable portion 37 of the minute detection wheel 34 when viewed in the axial direction.

When located at the first detection position, any one of the first center wheel transmittable portion 35 and the second center wheel transmittable portion 36 of the center wheel & pinion 33 can transmit the light emitted from the first light emitting element 61. In addition, when both the first center wheel transmittable portion 35 and the second center wheel transmittable portion 36 are located at other positions except for the first detection position, the center wheel & pinion 33 blocks the light emitted from the first light emitting element 61.

When located at the first detection position, any one of the first second wheel transmittable portion 45 and the second second wheel transmittable portion 46 of the second wheel & pinion 43 can transmit the light emitted from the first light emitting element 61. In addition, when both the first second wheel transmittable portion 45 and the second second wheel transmittable portion 46 are located at other positions except for the first detection position, the second wheel & pinion 43 blocks the light emitted from the first light emitting element 61.

When located at the first detection position, the hour wheel transmittable portion 57 of the hour wheel 53 can transmit the light emitted from the first light emitting element 61. In addition, when the hour wheel transmittable portion 57 is located at other positions except for the first detection position, the hour wheel 53 blocks the light emitted from the first light emitting element 61.

When located at the first detection position, the minute detection wheel transmittable portion 37 of the minute detection wheel 34 can transmit the light emitted from the first light emitting element 61. In addition, when the minute detection wheel transmittable portion 37 is located at other positions except for the first detection position, the minute detection wheel 34 blocks the light emitted from the first light emitting element 61.

The minute detection wheel transmittable portion 37 of the minute detection wheel 34 is disposed so as to be located at a position corresponding to the first center wheel transmittable portion 35 when viewed in the axial direction, in a first predetermined state where the center wheel & pinion 33 can transmit the light emitted from the first light emitting element 61 to the first light receiving element 64 in the first center wheel transmittable portion 35. In addition, the minute detection wheel transmittable portion 37 of the minute detection wheel 34 is disposed so as to be located at a position corresponding to the second center wheel transmittable portion 36 when viewed in the axial direction, in a second predetermined state where the center wheel & pinion 33 can transmit the light emitted from the first light emitting element 61 to the first light receiving element 64 in the second center wheel transmittable portion 36. That is, in a state where the first center wheel transmittable portion 35 is located at the first detection position and in a state where the second center wheel transmittable portion 36 is located at the first detection position, the minute detection wheel transmittable portion 37 is located at the first detection position.

The central angle θ (120°) between the first center wheel transmittable portion 35 and the second center wheel transmittable portion 36 in the center wheel & pinion 33 is integral multiplication of the rotation angle (12°) of the center wheel & pinion 33 per rotation of the minute detection wheel 34. In addition, the number of rotations of the minute detection wheel 34 per rotation of the center wheel & pinion 33 is 30 (that is, a gear ratio of the center wheel & pinion 33 with respect to the minute detection wheel 34 is 1/integer). Therefore, when the first center wheel transmittable portion 35 and the second center wheel transmittable portion 36 of the center wheel & pinion 33 are located at the first detection position, the minute detection wheel transmittable portion 37 of the minute detection wheel 34 is also located at the first detection position.

The second light emitting element 62 is arranged on the lower side in the axial direction with respect to the center wheel & pinion 33 and the second wheel & pinion 43, and is fixed to the main plate 20, for example. Similarly to the first light emitting element 61, the second light emitting element 62 is an LED or an LD, and can emit the light upward. The second light emitting element 62 is connected to the light emitting control unit 18.

The second light receiving element 65 is arranged at a position for receiving the light emitted from the second light emitting element 62. The second light receiving element 65 is disposed on the upper side in the axial direction, across the center wheel & pinion 33 and the second wheel & pinion 43, and is fixed to the train wheel bridge 29, for example. Similarly to the first light receiving element 64, the second light receiving element 65 is a photo diode, for example, and detects the light emitted from the second light emitting element 62. The second light receiving element 65 is connected to the detection control unit 19.

Through-holes 20*b* and 29*b* respectively penetrating the main plate 20 and the train wheel bridge 29 in the axial direction are formed at a position corresponding to a portion between the second light emitting element 62 and the second light receiving element 65 (hereinafter, referred to as a "second detection position"). The light emitted from the second light emitting element 62 is incident on the second light receiving element 65 after passing through the through-holes 29*b* and 20*b*.

The center wheel & pinion 33, the second wheel & pinion 43, the second detection wheel 44, and the hour wheel 53 are arranged at the second detection position. The second detection position overlaps the rotation trajectory of the first center wheel transmittable portion 35 and the second center wheel transmittable portion 36 of the center wheel & pinion 33 when viewed in the axial direction. In this manner, the second detection position overlaps the rotation trajectory of the first second wheel transmittable portion 45 and the second second wheel transmittable portion 46 of the second wheel & pinion 43 and the rotation trajectory of the hour wheel transmittable portion 57 of the hour wheel 53 when viewed in the axial direction. In addition, the second detection position overlaps the rotation trajectory of the second detection wheel transmittable portion 47 of the second detection wheel 44 when viewed in the axial direction. Furthermore, the second light receiving element 65 is disposed so as to be capable of detecting the light which is emitted from the second light emitting element 62 and transmitted through the second center wheel transmittable portion 36 in the first predetermined state where the center wheel & pinion 33 can transmit the light emitted from the first light emitting element 61 to the first light receiving element 64 in the first center wheel transmittable portion 35. That is, the second detection position is disposed corresponding to a position of the second center wheel transmittable portion 36 in a state where the first center wheel transmittable portion 35 is located at the first detection position. The second detection position is disposed at a position where the second detection position is moved as much as θ in the direction CCW along the circumferential direction around the center axle O with respect to the first detection position.

When located at the second detection position, any one of the first center wheel transmittable portion 35 and the second center wheel transmittable portion 36 of the center wheel & pinion 33 can transmit the light emitted from the second light emitting element 62. In addition, when both the first center wheel transmittable portion 35 and the second center wheel transmittable portion 36 are located at other positions except for the second detection position, the center wheel & pinion 33 blocks the light emitted from the second light emitting element 62.

When located at the second detection position, any one of the first second wheel transmittable portion 45 and the second second wheel transmittable portion 46 of the second wheel & pinion 43 can transmit the light emitted from the second light emitting element 62. In addition, when both the first second wheel transmittable portion 45 and the second second wheel transmittable portion 46 are located at other positions except for the second detection position, the second wheel & pinion 43 blocks the light emitted from the second light emitting element 62.

When located at the second detection position, the hour wheel transmittable portion 57 of the hour wheel 53 can transmit the light emitted from the second light emitting element 62. In addition, when the hour wheel transmittable portion 57 is located at other positions except for the second detection position, the hour wheel 53 blocks the light emitted from the second light emitting element 62.

When located at the second detection position, the second detection wheel transmittable portion 47 of the second detection wheel 44 can transmit the light emitted from the second light emitting element 62. In addition, when the second detection wheel transmittable portion 47 is located at other positions except for the second detection position, the second detection wheel 44 blocks the light emitted from the second light emitting element 62.

The second detection wheel transmittable portion 47 of the second detection wheel 44 is disposed so as to be located at a position corresponding to the second second wheel transmittable portion 46 when viewed in the axial direction, in a state where the second wheel & pinion 43 can transmit the light emitted from the second light emitting element 62 to the second light receiving element 65 in the second second wheel transmittable portion 46. That is, in a state where the second second wheel transmittable portion 46 is located at the second detection position, the second detection wheel transmittable portion 47 is located at the second detection position.

The number of rotations of the second detection wheel 44 per rotation of the second wheel & pinion 43 is 24 (that is, a gear ratio of the second wheel & pinion 43 with respect to the second detection wheel 44 is 1/integer). Therefore, when the second second wheel transmittable portion 46 of the second wheel & pinion 43 is located at the second detection position, the second detection wheel transmittable portion 47 of the second detection wheel 44 is also located at the second detection position.

As illustrated in FIGS. 2 and 4, the third light emitting element 63 is arranged on the lower side in the axial direction with respect to the intermediate minute wheel 51, the minute wheel 52, and the hour detection wheel 54, and is fixed to the main plate 20, for example. Similarly to the first light emitting element 61, the third light emitting element 63 is an LED or an LD, for example, and can emit the light upward. The third light emitting element 63 is connected to the light emitting control unit 18.

The third light receiving element 66 is arranged at a position for receiving the light emitted from the third light emitting element 63. The third light receiving element 66 is disposed on the upper side in the axial direction, across the intermediate minute wheel 51, the minute wheel 52, and the hour detection wheel 54, and is fixed to the train wheel bridge 29, for example. Similarly to the first light receiving element 64, the third light receiving element 66 is a photo diode, for example, and detects the light emitted from the third light emitting element 63. The third light receiving element 66 is connected to the detection control unit 19.

Through-holes 20*c* and 29*c* respectively penetrating the main plate 20 and the train wheel bridge 29 in the axial direction are formed at a position corresponding to a portion between the third light emitting element 63 and the third light receiving element 66 (hereinafter, referred to as a "third detection position"). The light emitted from the third light emitting element 63 is incident on the third light receiving element 66 after passing through the through-holes 29*c* and 20*c*.

The third detection position overlaps the rotation trajectory of the intermediate minute wheel transmittable portion 55 of the intermediate minute wheel 51 when viewed in the axial direction. In addition, the third detection position overlaps the rotation trajectory of the minute wheel transmittable portion 56 of the minute wheel 52 when viewed in the axial direction. Furthermore, the third detection position overlaps the rotation trajectory of the hour detection wheel transmittable portion 58 of the hour detection wheel 54 when viewed in the axial direction.

When located at the third detection position, the intermediate minute wheel transmittable portion 55 of the intermediate minute wheel 51 can transmit the light emitted from the third light emitting element 63. In addition, when the intermediate minute wheel transmittable portion 55 is located at other positions except for the third detection position, the intermediate minute wheel 51 blocks the light emitted from the third light emitting element 63.

When located at the third detection position, the minute wheel transmittable portion 56 of the minute wheel 52 can transmit the light emitted from the third light emitting element 63. In addition, when the minute wheel transmittable portion 56 is located at other positions except for the third detection position, the minute wheel 52 blocks the light emitted from the third light emitting element 63.

When the hour detection wheel transmittable portion 58 of the hour detection wheel 54 is located at the third detection position, the hour detection wheel transmittable portion 58 can transmit the light emitted from the third light emitting element 63. In addition, when the hour detection wheel transmittable portion 58 is located at other positions except for the third detection position, the hour detection wheel 54 blocks the light emitted from the third light emitting element 63.

The intermediate minute wheel transmittable portion 55 of the intermediate minute wheel 51 and the minute wheel transmittable portion 56 of the minute wheel 52 are located at the third detection position, in a state where the hour detection wheel transmittable portion 58 of the hour detection wheel 54 is located at the third detection position.

Hand Position Detection Operation

Next, a hand position detection operation according to the present embodiment will be described.

In the hand position detection operation, in order to detect the position of the hour hand 12, the minute hand 13, and the second hand 14, each rotation position of the center wheel & pinion 33, the second wheel & pinion 43, and the hour wheel 53 is detected. In the following description, description with regard to the position detection operation of the hour hand 12 will be omitted. In addition, the reference numeral of each configuration component in the following description is the same as that in FIGS. 2 to 12.

Figure 13:
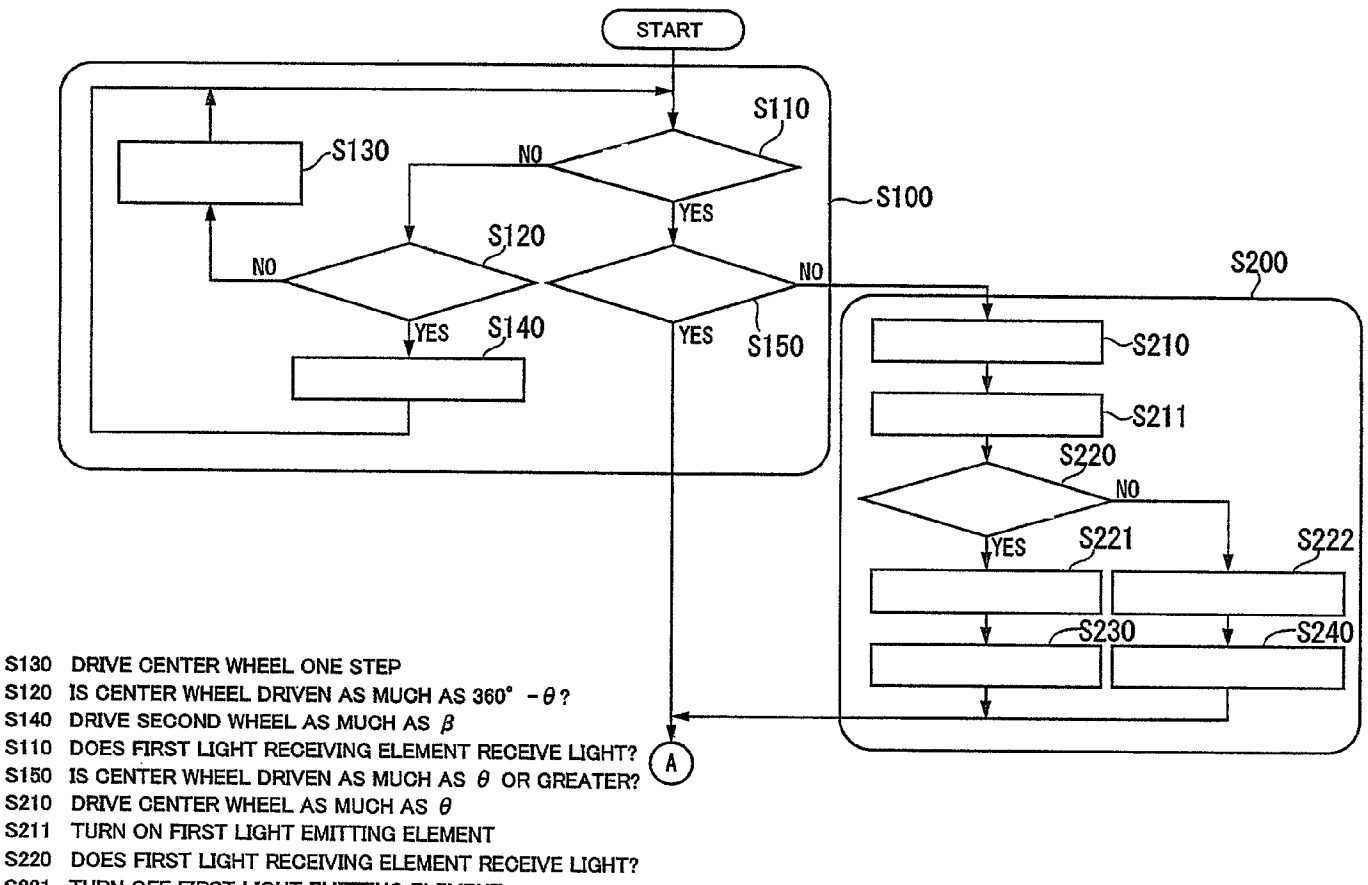
FIG. 13 is a flowchart illustrating a hand position detection operation.
Figure 14:
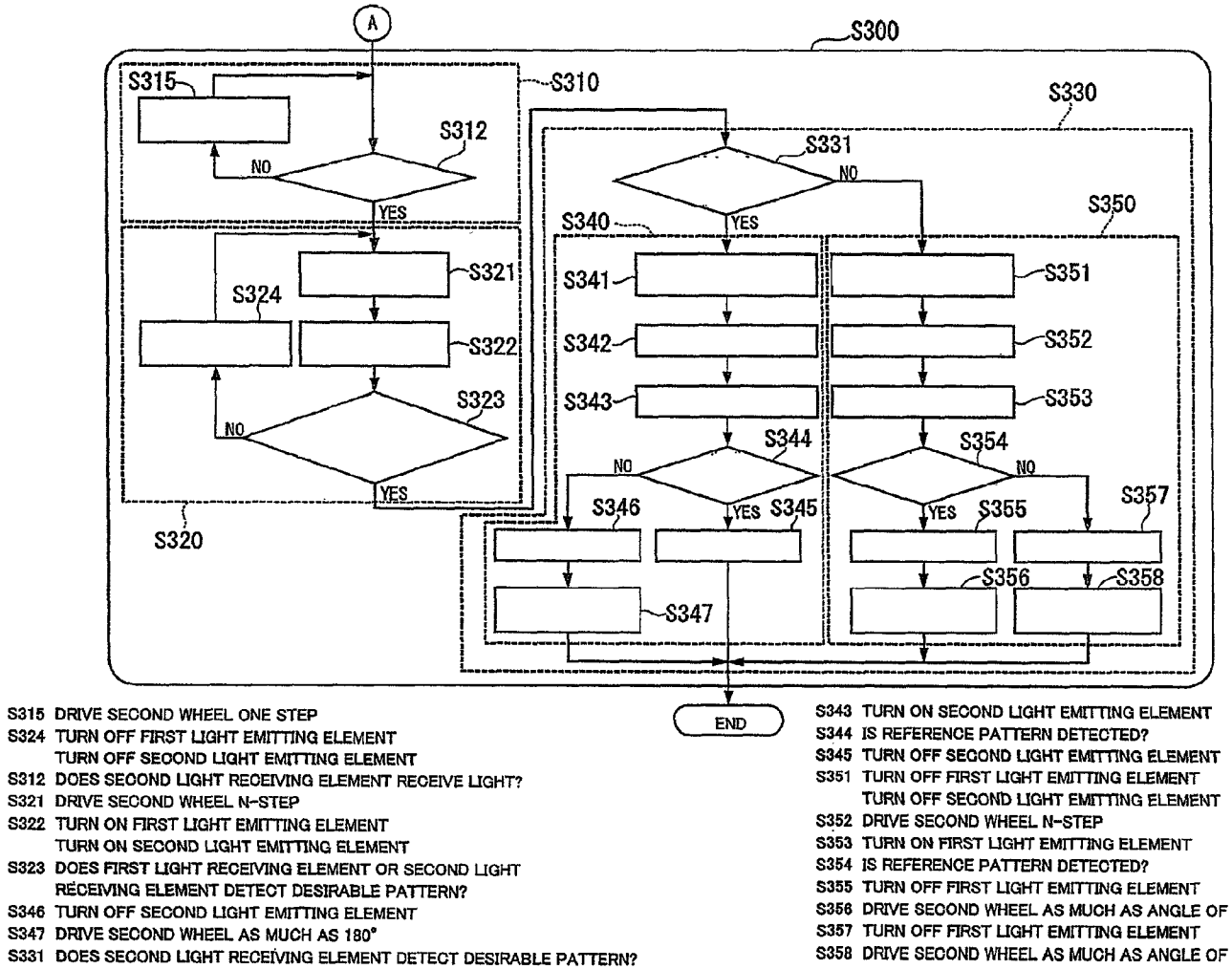
FIG. 14 is a flowchart illustrating the hand position detection operation.
Figure 15:
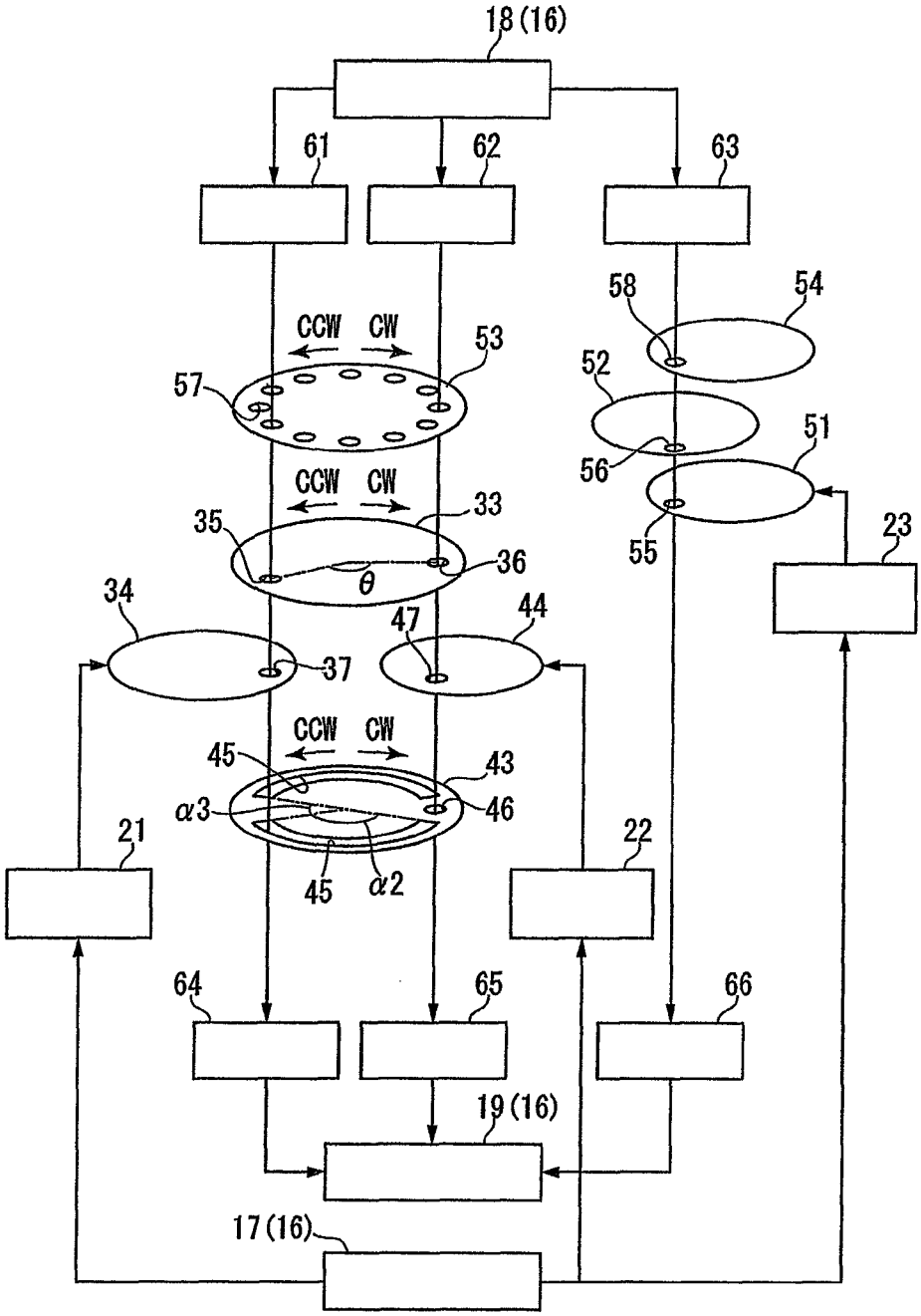
FIG. 15 is a block diagram of the movement.

FIGS. 13 and 14 are flowcharts of the hand position detection operation. FIG. 15 is a block diagram schematically illustrating the movement. FIG. 15 schematically illustrates a state where the hand position detection operation is completed.

As illustrated in FIGS. 13 and 14, the hand position detection operation according to the present embodiment includes a minute transmitted state searching Step S100 of searching for the first center wheel transmittable portion 35 or the second center wheel transmittable portion 36 of the center wheel & pinion 33, a second transmitted state searching Step S200 performed in a case where it is unclear whether any one of the first center wheel transmittable portion 35 and the second center wheel transmittable portion 36 is located at the first detection position when the minute transmitted state searching Step S100 is completed, and a second transmitted state searching Step S300 of searching for the second second wheel transmittable portion 46 of the second wheel & pinion 43.

First, before the above-described respective steps are performed, the hour wheel 53 is rotated by the third stepping motor 23 so that any one of the multiple hour wheel transmittable portions 57 is located at the first detection position. In this case, the multiple hour wheel transmittable portions 57 are arrayed at an interval of 30°. Accordingly, any one of the multiple hour wheel transmittable portions 57 is also in a state of being located at the second detection position.

Minute Transmitted State Searching Step

Next, the minute transmitted state searching Step S100 will be described.

As illustrated in FIG. 13, the minute transmitted state searching Step S100 includes a transmitted state determination Step S110, a rotation angle determination Step S120, a first drive Step S130, a second drive Step S140, and Step S150.

In the minute transmitted state searching Step S100, first, the light emitting control unit 18 of the control unit 16 supplies the power to the first light emitting element 61 so as to emit the light from the first light emitting element 61, and the detection control unit 19 of the control unit 16 operates the first light receiving element 64. In each flow described below, the operation of the first light receiving element 64 is interlinked with the light emitting of the first light emitting element 61.

Next, the control unit 16 determines whether or not the first light receiving element 64 receives the light emitted from the first light emitting element 61 (transmitted state determination Step S110). In the transmitted state determination Step S110, when any one of the first center wheel transmittable portion 35 and the second center wheel transmittable portion 36 of the center wheel & pinion 33, any one of the first second wheel transmittable portion 45 and the second second wheel transmittable portion 46 of the second wheel & pinion 43, and the minute detection wheel transmittable portion 37 of the minute detection wheel 34 are located at the first detection position, the first light receiving element 64 detects the light emitted from the first light emitting element 61 (refer to FIG. 15).

In the transmitted state determination Step S110, in a case where the control unit 16 determines that the light emitted from the first light emitting element 61 is not transmitted through the center wheel & pinion 33 and the first light receiving element 64 does not receive the light emitted from the first light emitting element 61 (S110: No), the control unit 16 determines whether or not the rotation angle of the center wheel & pinion 33 is equal to or larger than 360°−θ (240° in the present embodiment) (rotation angle determination Step S120). In the rotation angle determination Step S120, the control unit 16 determines whether or not the rotation angle of the center wheel & pinion 33 after the hand position detection operation starts, which is stored in the control unit 16, is equal to or larger than 360°−θ. When the rotation angle determination Step S120 is performed for the first time, the rotation angle of the center wheel & pinion 33 which is stored in the control unit 16 is 0°.

In the rotation angle determination Step S120, in a case where the rotation control unit 17 determines that the rotation angle of the center wheel & pinion 33 is smaller than 360°−θ (S120: No), the rotation control unit 17 causes the first stepping motor 21 to perform one step rotation driving, and rotates the center wheel & pinion 33 in the direction CW as much as the rotation angle (1° in the present embodiment) corresponding to one step of the first stepping motor 21 (first drive Step S130). In the first drive Step S130, in response to the one step rotation driving of the first stepping motor 21, the minute detection wheel 34 is also rotated as much as the rotation angle (30° in the present embodiment) corresponding to one step of the first stepping motor 21. Subsequently, the transmitted state determination Step S110 is performed again.

Here, a case will be described where it is determined that the rotation angle of the center wheel & pinion 33 is equal to or larger than 360°−θ in the rotation angle determination Step S120 (S120: Yes).

Figure 16:
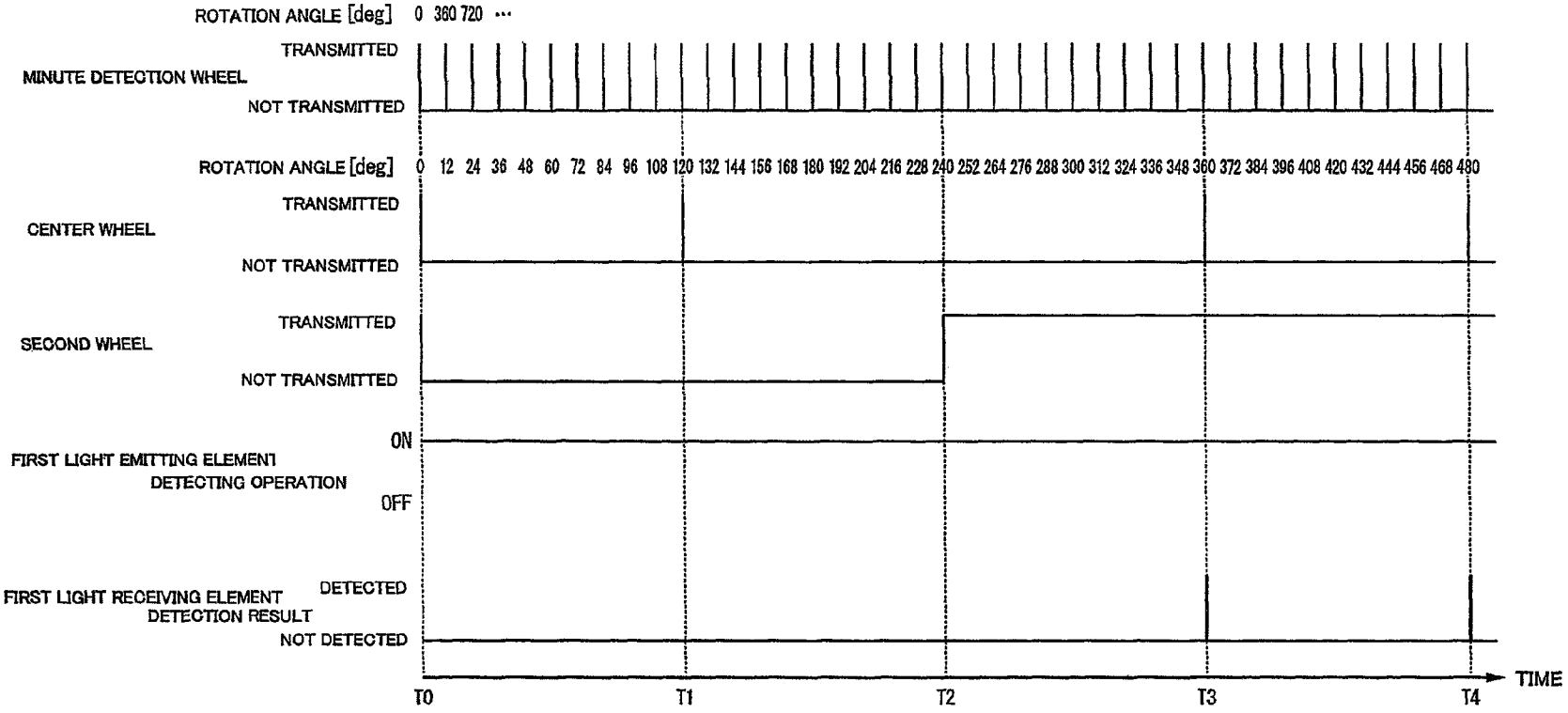
FIG. 16 is a timing chart illustrating a minute transmitted state searching step.

FIG. 16 is a timing chart illustrating the minute transmitted state searching step. A transmitted state in the minute detection wheel, the center wheel & pinion, and the second wheel & pinion in FIG. 16 represents a state where each transmittable portion belonging to the minute detection wheel, the center wheel & pinion, and the second wheel & pinion is located at the first detection position. In addition, a non-transmitted state represents a state where each transmittable portion belonging to the minute detection wheel, the center wheel & pinion, and the second wheel & pinion is located at other positions except for the first detection position.

If the transmitted state determination Step S110, the rotation angle determination Step S120, and the first drive Step S130 are repeatedly performed, the center wheel & pinion 33 and the minute detection wheel 34 are rotated. Whenever the minute detection wheel 34 is rotated once, the minute detection wheel transmittable portion 37 of the minute detection wheel 34 passes through the first detection position once. Accordingly, whenever the minute detection wheel 34 is rotated once, the transmitted state and the non-transmitted state are repeated once (refer to FIG. 16). Whenever the center wheel & pinion 33 is rotated once, the first center wheel transmittable portion 35 and the second center wheel transmittable portion 36 of the center wheel & pinion 33 respectively pass through the first detection position once. Accordingly, whenever the center wheel & pinion 33 is rotated once, the transmitted state and the non-transmitted state are repeated twice (refer to FIG. 16). When the center wheel & pinion 33 is brought into the transmitted state, the minute detection wheel 34 is also brought into the transmitted state.

If the center wheel & pinion 33 is rotated as much as 360°−θ at the most, at least any one of the first center wheel transmittable portion 35 and the second center wheel transmittable portion 36 passes through the first detection position (refer to FIG. 15). Therefore, even if the center wheel & pinion 33 is rotated as much as 360°−θ, in a case where the first light receiving element 64 does not detect the light emitted from the first light emitting element 61, the first second wheel transmittable portion 45 and the second second wheel transmittable portion 46 of the second wheel & pinion 43 are located at other positions except for the first detection position (period from time T0 to time T2 in FIG. 16).

In the rotation angle determination Step S120, in a case where it is determined that the rotation angle of the center wheel & pinion 33 is equal to or larger than 360°−θ (S120: Yes), the rotation control unit 17 drives the second stepping motor 22 so as to rotate the second wheel & pinion 43 as much as a predetermined angle β (90° in the present embodiment) (second drive Step S140). In the present embodiment, the central angle α2 formed by both end portions of the first second wheel transmittable portion 45 is set to 100°, and the central angle α3 between a pair of the first second wheel transmittable portions 45 in the circumferential direction of the second wheel & pinion 43 is set to 80°. Therefore, by rotating the second wheel & pinion 43 as much as the predetermined angle β (90° in the present embodiment) which is in a range from α3 to α2, the first second wheel transmittable portion 45 located at other positions except for the first detection position can be moved so as to be located at the first detection position (time T2 in FIG. 16). Subsequently, the rotation angle of the center wheel & pinion 33 which is stored in the control unit 16 is set to 0°, and the transmitted state determination Step S110 is performed again. Thereafter, the rotation angle determination Step S120, the first drive Step S130, and the transmitted state determination Step S110 are repeatedly performed again. In this manner, the first light receiving element 64 can detect any one of the first center wheel transmittable portion 35 and the second center wheel transmittable portion 36 (time T3 in FIG. 16).

In the transmitted state determination Step S110, in a case where it is determined that the light emitted from the first light emitting element 61 is transmitted through the center wheel & pinion 33 and the first light receiving element 64 receives the light emitted from the first light emitting element 61 (S110: Yes), the control unit 16 determines whether or not the rotation angle of the center wheel & pinion 33 which is stored in the control unit 16 is equal to or larger than θ (120° in the present embodiment) (Step S150).

Here, a case will be described where the rotation angle of the center wheel & pinion 33 which is stored in the control unit 16 is equal to or larger than θ (S150: Yes).

When it is determined as Yes in the transmitted state determination Step S110, in a case where the first center wheel transmittable portion 35 is located at the first detection position, the rotation angle of the center wheel & pinion 33 which is stored in the control unit 16 in Step S150 is equal to or larger than 0° and smaller than 360°−θ. In addition, when it is determined as Yes in the transmitted state determination Step S110, in a case where the second center wheel transmittable portion 36 is located at the first detection position, the rotation angle of the center wheel & pinion 33 which is stored in the control unit 16 in Step S150 is equal to or larger than 0° and smaller than θ. Therefore, in a case where it is determined as Yes in Step S150, the first center wheel transmittable portion 35 is located at the first detection position. In addition, the second center wheel transmittable portion 36 is located at the second detection position.

As described above, in a case where it is determined as Yes in Step S150, the rotation position of the center wheel & pinion 33 can be detected. Accordingly, the first light emitting element 61 is caused to stop the light emitting, the minute transmitted state searching Step S100 is completed, and the process proceeds to the second transmitted state searching Step S300 (refer to FIG. 14).

In a case where it is determined as No in Step S150, it is not possible to determine whether any one of the first center wheel transmittable portion 35 and the second center wheel transmittable portion 36 is located at the first detection position. Accordingly, the first light emitting element 61 is caused to stop the light emitting, the minute transmitted state searching Step S100 is completed, and the process proceeds to the second transmitted state searching Step S200.

In the present embodiment, in the minute transmitted state searching Step S100, the first light emitting element 61 is caused to always emit the light, but the configuration is not limited thereto. In the minute transmitted state searching Step S100, the first light emitting element 61 may be caused to emit the light immediately before the transmitted state determination Step S110, and the first light emitting element 61 may be caused to stop the light emitting after the transmitted state determination Step S110 is completed.

Second Transmitted State Searching Transfer Step

Next, the second transmitted state searching Step S200 will be described.

The second transmitted state searching Step S200 includes Step S210, Step S211, Step S220, Step S221, Step S222, Step S230, and Step S240.

In the second transmitted state searching Step S200, the rotation control unit 17 drives the first stepping motor 21 so that the center wheel & pinion 33 performs rotation driving in the direction CW as much as the angle θ (Step S210). In a case where the first center wheel transmittable portion 35 is located at the first detection position when Step S210 is performed, Step S210 is performed so as to move the second center wheel transmittable portion 36 to the first detection position. In a case where the second center wheel transmittable portion 36 is located at the first detection position when Step S210 is performed, Step S210 is performed so as to move the first center wheel transmittable portion 35 and the second center wheel transmittable portion 36 to other positions except for the first detection position.

Next, the first light emitting element 61 is caused to emit the light (Step S211). Similarly to the transmitted state determination Step S110, the control unit 16 determines whether or not the first light receiving element 64 receives the light emitted from the first light emitting element 61 (Step S220).

In Step S220, in a case where the control unit 16 determines that the light emitted from the first light emitting element 61 is transmitted through the center wheel & pinion 33 and the first light receiving element 64 receives the light emitted from the first light emitting element 61 (S220: Yes), the second center wheel transmittable portion 36 is located at the first detection position at that time. Accordingly, the first light emitting element 61 is caused to stop the light emitting (Step S221), and the center wheel & pinion 33 is caused to perform rotation driving in the direction CW as much as 360°−θ (Step S230). In this manner, the first center wheel transmittable portion 35 can be moved to the first detection position. In addition, the second center wheel transmittable portion 36 can be moved to the second detection position. Through the above-described processes, the rotation position of the center wheel & pinion 33 is completely detected. After Step S230 is performed, the second transmitted state searching Step S200 is completed, and the process proceeds to the second transmitted state searching Step S300.

In Step S220, in a case where the light emitted from the first light emitting element 61 is not transmitted through the center wheel & pinion 33 and the first light receiving element 64 does not receive the light emitted from the first light emitting element 61 (S220: No), the second center wheel transmittable portion 36 is located at the first detection position when Step S210 is performed. Accordingly, the first light emitting element 61 is caused to stop the light emitting (Step S222), and the center wheel & pinion 33 is caused to perform rotation driving in the direction CW as much as the angle θ (Step S240). In this manner, the first center wheel transmittable portion 35 can be moved to the first detection position. In addition, the second center wheel transmittable portion 36 can be moved to the second detection position. Through the above-described processes, the rotation position of the center wheel & pinion 33 is completely detected. After Step S240 is performed, the second transmitted state searching Step S200 is completed, and the process proceeds to the second transmitted state searching Step S300 (refer to FIG. 14).

Second Transmitted State Searching Step

Next, the second transmitted state searching Step S300 will be described.

As illustrated in FIG. 14, the second transmitted state searching Step S300 includes a second detection wheel transmittable portion searching Step S310 (fifth transmittable portion searching step), a desirable pattern searching Step S320, and a reference pattern searching Step S330.

Figure 17:
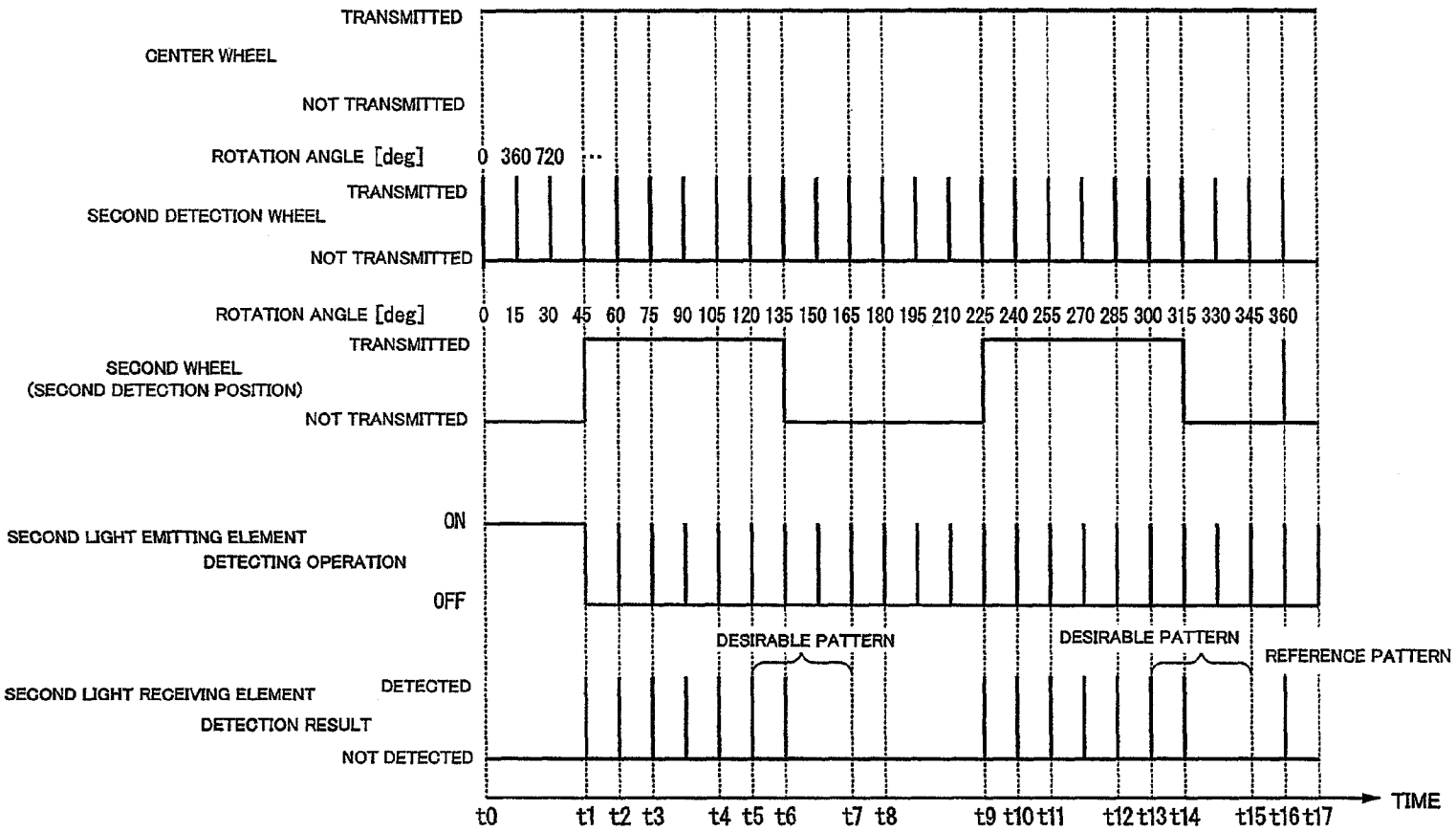
FIG. 17 is a timing chart illustrating a second transmitted state searching step.
Figure 18:
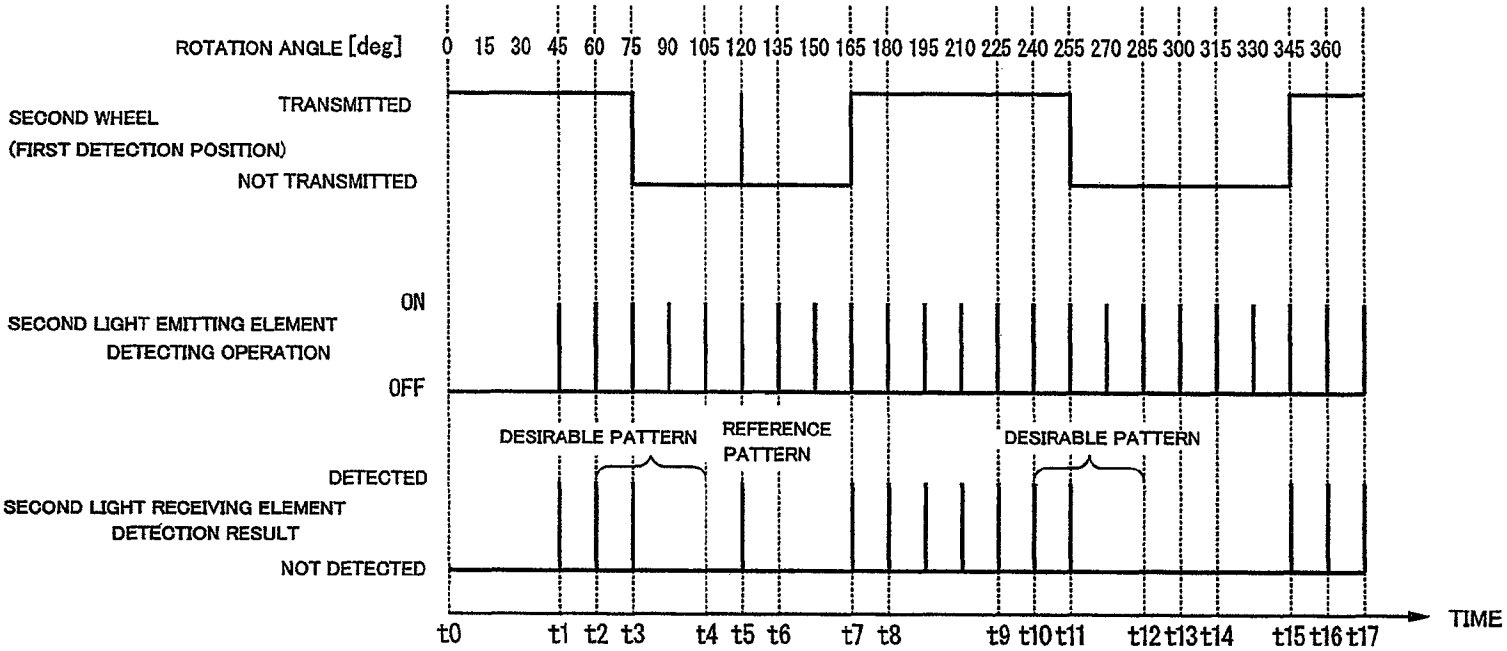
FIG. 18 is a timing chart illustrating the second transmitted state searching step.

FIGS. 17 and 18 are timing charts illustrating the second transmitted state searching step. A transmitted state in the center wheel & pinion in FIG. 17 represents a state where the transmittable portion belonging to the center wheel & pinion is located at the first detection position and the second detection position. In addition, a non-transmitted state represents a state where the transmittable portion belonging to the center wheel & pinion is located at other positions except for the first detection position and the second detection position. In the second transmitted state searching Step S300, the first center wheel transmittable portion 35 is located at the first detection position, and the second center wheel transmittable portion 36 is located at the second detection position. Accordingly, in the second transmitted state searching Step S300, the center wheel & pinion 33 is always in the transmitted state.

In addition, a transmitted state in the second detection wheel and the second wheel & pinion (second detection position) in FIG. 17 represents a state where each transmittable portion belonging to the second detection wheel and the second wheel & pinion is positioned at the second detection position. In addition, a non-transmitted state represents a state where each transmittable portion belonging to the second detection wheel and the second wheel & pinion is positioned at other positions except for the second detection position.

In addition, a transmitted state in the second wheel & pinion (first detection position) in FIG. 18 represents a state where the transmittable portion belonging to the second wheel & pinion is positioned at the first detection position. In addition, a non-transmitted state represents a state where the transmittable portion belonging to the second wheel & pinion is positioned at other positions except for the first detection position.

In the second transmitted state searching Step S300, the control unit 16 causes the second light emitting element 62 to emit the light, and causes the second light receiving element 65 to receive the light transmitted through the first second wheel transmittable portion 45 or the second second wheel transmittable portion 46, thereby detecting the rotation position of the second wheel & pinion 43. In the second transmitted state searching Step S300, the second detection wheel transmittable portion searching Step S310 is first performed.

In the second detection wheel transmittable portion searching Step S310, the control unit 16 detects a transmitting time point that the light which is emitted from the second light emitting element 62 and which is transmitted through the first second wheel transmittable portion 45 or the second second wheel transmittable portion 46 is concurrently transmitted through the second detection wheel transmittable portion 47. In other words, in the second detection wheel transmittable portion searching Step S310, the control unit 16 searches for a state where the second detection wheel transmittable portion 47 of the second detection wheel 44 is located at the second detection position (predetermined position). In the second detection wheel transmittable portion searching Step S310, first, the light emitting control unit 18 of the control unit 16 supplies the power to the second light emitting element 62 so as to emit the light from the second light emitting element 62, and the detection control unit 19 of the control unit 16 operates the second light receiving element 65. In each flow described below, similarly to the first light emitting element 61 and the first light receiving element 64, the operation of the second light receiving element 65 is interlinked with the light emitting of the second light emitting element 62.

Next, Step S312 is performed. In Step S312, the control unit 16 determines whether or not the second light receiving element 65 receives the light emitted from the second light emitting element 62. In Step S312, the second light receiving element 65 detects the light emitted from the second light emitting element 62, when any one of the second center wheel transmittable portion 36 of the center wheel & pinion 33, and the first second wheel transmittable portion 45 and the second second wheel transmittable portion 46 of the second wheel & pinion 43, and the second detection wheel transmittable portion 47 of the second detection wheel 44 are located at the second detection position (refer to FIG. 15).

In Step S312, in a case where it is determined that the second light receiving element 65 receives the light emitted from the second light emitting element 62 (S312: Yes), the second detection wheel transmittable portion 47 is located at the second detection position. Accordingly, the second light emitting element 62 is caused to stop the light emitting, the second detection wheel transmittable portion searching Step S310 is completed, and the process proceeds to the desirable pattern searching Step S320. At this time, the control unit 16 completes the detection of the transmitting time point.

In contrast, in Step S312, in a case where it is determined that the second light receiving element 65 does not receive the light emitted from the second light emitting element 62 (S312: No), the process proceeds to Step S315. In Step S315, the rotation control unit 17 causes the second stepping motor 22 to perform one step rotation driving, and rotates the second wheel & pinion 43 in the direction CW as much as the rotation angle (1.5° in the present embodiment) corresponding to one step of the second stepping motor 22. In Step S315, in response to one step rotation driving of the second stepping motor 22, the second detection wheel 44 is also rotated as much as the rotation angle (36° in the present embodiment) corresponding to one step of the second stepping motor 22. Subsequently, Step S312 is performed again.

In the present embodiment, in the second detection wheel transmittable portion searching Step S310, the second light emitting element 62 is caused to always emit the light, but the configuration is not limited thereto. In the second detection wheel transmittable portion searching Step S310, the second light emitting element 62 may be caused to emit the light immediately before Step S312, and the second light emitting element 62 may be caused to stop the light emitting after Step S312 is completed.

When the control unit 16 drives the second stepping motor 22 after the desirable pattern searching Step S320, the control unit 16 causes the second stepping motor 22 to perform stepwise rotation driving per predetermined number of times N (10 steps in the present embodiment) corresponding to one rotation of the second detection wheel 44. In addition, while the second stepping motor 22 is driven after the desirable pattern searching Step S320, the control unit 16 causes the first light emitting element 61 and the second light emitting element 62 to stop the light emitting (after time t1 in FIG. 17). In other words, after the transmitting time point, when the second detection wheel transmittable portion 47 is located at other positions except for the second detection position where the second detection wheel transmittable portion 47 is located at the transmitting time point, the control unit 16 causes the second light emitting element 62 to stop the light emitting. It is desirable that a duty ratio of the light emitting of the first light emitting element 61 and the second light emitting element 62 is equal to or smaller than 50%. In the following description, in some cases, an operation for causing the second stepping motor 22 to perform stepwise rotation driving a predetermined number of times N and causing at least any one of the first light emitting element 61 and the second light emitting element 62 to emit the light is referred to as an "intermittent detecting operation".

In the desirable pattern searching Step S320, the intermittent detecting operation is performed at the first detection position and the second detection position. Specifically, in the desirable pattern searching Step S320, Step S321 is performed. In Step S321, the rotation control unit 17 causes the second stepping motor 22 to perform stepwise rotation driving the predetermined number of times N, and rotates the second wheel & pinion 43 in the direction CW as much as the rotation angle (15° in the present embodiment) corresponding to N-steps of the second stepping motor 22. In Step S321, in response to N-stepwise rotation driving of the second stepping motor 22, the second detection wheel 44 is also rotated once. After Step S321 is performed, the second detection wheel transmittable portion 47 of the second detection wheel 44 is in a state of being located at the second detection position. Subsequently, the control unit 16 causes the first light emitting element 61 and the second light emitting element 62 to emit the light (Step S322), and the desirable pattern determination Step S323 (first determination step) is performed.

In the desirable pattern determination Step S323, the control unit 16 determines whether or not any one of the first light receiving element 64 and the second light receiving element 65 detects a desirable pattern (first pattern) indicating that the first second wheel transmittable portion 45 passes through a position (second detection position) corresponding to the second center wheel transmittable portion 36 when viewed in the axial direction. In the desirable pattern determination Step S323, in a case where it is determined that any one of the first light receiving element 64 and the second light receiving element 65 detects the desirable pattern (S323: Yes), the desirable pattern searching Step S320 is completed, and the process proceeds to the reference pattern searching Step S330. In contrast, in the desirable pattern determination Step S323, in a case where it is determined that anyone of the first light receiving element 64 and the second light receiving element 65 does not detect the desirable pattern (S323: No), the control unit 16 causes the first light emitting element 61 and the second light emitting element 62 to stop the light emitting (Step S324), and Step S321 is performed again.

Here, the desirable pattern will be described. As illustrated in FIGS. 14 and 17, if Step S321, Step S322, the desirable pattern determination Step S323, and Step S324 are repeatedly performed, the second wheel & pinion 43 and the second detection wheel 44 are rotated. Whenever the second detection wheel 44 is rotated once, the second detection wheel transmittable portion 47 of the second detection wheel 44 passes through the second detection position once. Accordingly, whenever the second detection wheel 44 is rotated once, the transmitted state and the non-transmitted state are repeated once. Whenever the second wheel & pinion 43 is rotated once, a pair of the first second wheel transmittable portions 45 and the second second wheel transmittable portions 46 of the second wheel & pinion 43 respectively pass through the second detection position once. The second wheel & pinion 43 has the first second wheel transmittable portion 45 having a long hole. Accordingly, the second wheel & pinion 43 is in a continuously transmitted state over a period while the first second wheel transmittable portion 45 is located at the second detection position (for example, a period from time t1 to time t6 in FIG. 17).

The second light emitting element 62 emits the light when the second detection wheel transmittable portion 47 of the second detection wheel 44 is located at the second detection position. When the first second wheel transmittable portion 45 of the second wheel & pinion 43 passes through the second detection position, the second light receiving element 65 intermittently detects the light emitted from the second light emitting element 62 at equal intervals multiple times (seven times in the present embodiment). In addition, when the second second wheel transmittable portion 46 of the second wheel & pinion 43 passes through the second detection position, the second light receiving element 65 detects the light emitted from the second light emitting element 62 once. Therefore, after the second light receiving element 65 intermittently detects the light multiple times, when the second light receiving element 65 no longer detects the light during the subsequent intermittent detecting operation, it is possible to determine that the first second wheel transmittable portion 45 passes through the second detection position. In the present embodiment, a light transmitted pattern (desirable pattern) detected by the second light receiving element 65 is set to be a pattern which shows "detection-detection-no detection-no detection" whenever the second stepping motor 22 is rotated the predetermined number of times N (for example, refer to a period from time t5 to time t7 in FIG. 17). In this manner, the control unit 16 can determine that the first second wheel transmittable portion 45 passes through the second detection position.

In addition, in the present embodiment, the first detection position is disposed at a position where the first detection position is moved from the second detection position as much as an angle of 120° in the direction CW along the circumferential direction around the center axle O (refer to FIG. 15). Accordingly, a portion located at the second detection position in the second wheel & pinion 43 is moved to the first detection position by performing Step S321 as much as 120°/(1.5°×N).

The first light emitting element 61 emits the light concurrently with the second light emitting element 62. Accordingly, the first light receiving element 64 can detect the light emitted from the first light emitting element 61 as an intermittent pattern which is similar to the pattern of the light detected by the second light receiving element 65. Therefore, as illustrated in FIG. 18, it is determined whether or not the first light receiving element 64 detects the desirable pattern. In this manner, the control unit 16 can determine whether or not the first second wheel transmittable portion 45 passes through the first detection position.

As illustrated in FIG. 14, in the reference pattern searching Step S330, a light receiving element determination Step S331 (second determination step) is performed. In the light receiving element determination Step S331, the control unit 16 determines whether or not the second light receiving element 65 detects the desirable pattern.

In the light receiving element determination Step S331, in a case where it is determined that the second light receiving element 65 detects the desirable pattern (S331: Yes), the process proceeds to a first reference pattern determination Step S340 (third determination step). In contrast, in the light receiving element determination Step S331, in a case where it is determined that the second light receiving element 65 does not detect the desirable pattern (S331: No), that is, in a case where the first light receiving element 64 detects the desirable pattern, the process proceeds to a second reference pattern determination Step S350 (fourth determination step).

In the first reference pattern determination Step S340, the control unit 16 causes the first light emitting element 61 and the second light emitting element 62 to stop the light emitting (Step S341). Subsequently, similarly to Step S321, the rotation control unit 17 causes the second stepping motor 22 to perform stepwise rotation driving the predetermined number of times N, and rotates the second wheel & pinion 43 and the second detection wheel 44 (Step S342). Subsequently, the control unit 16 causes the second light emitting element 62 to emit the light (Step S343), and determines whether or not the second light receiving element 65 detects a reference pattern (second pattern) indicating that the second second wheel transmittable portion 46 passes through the second detection position (Step S344).

Here, the reference pattern will be described. As illustrated in FIG. 7, a pair of light-blocking regions for blocking the light are disposed in the second wheel & pinion 43 across end portions of a pair of the first second wheel transmittable portions 45 in the circumferential direction of the second wheel & pinion 43. The second second wheel transmittable portion 46 is disposed in one of the light-blocking regions. In the present embodiment, if the intermittent detecting operation is repeatedly performed, during a period while the light-blocking region of the second wheel & pinion 43 passes through the second detection position, the second light receiving element 65 is not successively detected five times (for example, a period from time t6 to time t9 in FIG. 17). The second second wheel transmittable portion 46 is disposed at an intermediate position between a pair of the first second wheel transmittable portions 45 (that is, in the light-blocking region). Accordingly, when the intermittent detecting operation is performed three times after the first second wheel transmittable portion 45 passes through the second detection position, it is determined whether or not the second light receiving element 65 detects the light emitted from the second light emitting element 62. In this manner, it is possible to determine whether or not the second second wheel transmittable portion 46 is located at the second detection position. In the present embodiment, the desirable pattern is set to "detection-detection-no detection-no detection". Therefore, the light transmitted pattern (reference pattern) detected in the second light receiving element 65 is set to the pattern showing "detection". In this manner, the control unit 16 can determine that the second second wheel transmittable portion 46 is located at the second detection position (for example, time t5 in FIG. 18).

In Step S344, in a case where it is determined that the second light receiving element 65 detects the reference pattern (S344: Yes, time t16 in FIG. 17), the second second wheel transmittable portion 46 is located at the second detection position. In this manner, it is possible to determine the rotation position of the second wheel & pinion 43. Accordingly, the second light emitting element 62 is caused to stop the light emitting (Step S345), and the reference pattern searching Step S330 and the second transmitted state searching Step S300 are completed. Through the above-described processes, the hand position detection operation is completed.

In Step S344, in a case where it is determined that the second light receiving element 65 does not detect the reference pattern (S344: No, time t8 in FIG. 17), the second second wheel transmittable portion 46 is not located at the second detection position, and is located at a position where the second second wheel transmittable portion 46 is rotated from the second detection position as much as an angle of 180° around the center axle O. In this manner, it is possible to determine the rotation position of the second wheel & pinion 43. Accordingly, the second light emitting element 62 is caused to stop the light emitting (Step S346), the second wheel & pinion 43 is rotated as much as an angle of 180° (Step S347), and the second second wheel transmittable portion 46 is moved to the second detection position. Subsequently, the reference pattern searching Step S330 and the second transmitted state searching Step S300 are completed. Through the above-described processes, the hand position detection operation is completed.

In the second reference pattern determination Step S350, the control unit 16 causes the first light emitting element 61 and the second light emitting element 62 to stop the light emitting (Step S351). Subsequently, similarly to Step S342, the rotation control unit 17 causes the second stepping motor 22 to perform stepwise rotation driving the predetermined number of times N, and rotates the second wheel & pinion 43 and the second detection wheel 44 (Step S352). Subsequently, the control unit 16 causes the first light emitting element 61 to emit the light (step S353), and determines whether or not the first light receiving element 64 detects the reference pattern indicating that the second second wheel transmittable portion 46 passes through the first detection position (Step S354). The reference pattern in Step S354 is set to be similar to the reference pattern in Step S344. Accordingly, similarly to S344, the control unit 16 can determine that the second second wheel transmittable portion 46 is located at the first detection position.

In Step S354, in a case where it is determined that the first light receiving element 64 detects the reference pattern (S354: Yes, time t5 in FIG. 18), the second second wheel transmittable portion 46 is located at the first detection position. In this manner, it is possible to determine the rotation position of the second wheel & pinion 43. Accordingly, the first light emitting element 61 is caused to stop the light emitting (Step S355), the second wheel & pinion 43 is rotated as much as 360°−θ (240° in the present embodiment) in the direction CW (Step S356), and the second second wheel transmittable portion 46 is moved to the second detection position. Subsequently, the reference pattern searching Step S330 and the second transmitted state searching Step S300 are completed. Through the above-described processes, the hand position detection operation is completed.

In Step S354, in a case where it is determined that the first light receiving element 64 does not detect the reference pattern (S354: No, time t13 in FIG. 18), the second second wheel transmittable portion 46 is not located at the first detection position, and is located at a position where the second second wheel transmittable portion 46 is rotated from the first detection position as much as an angle of 180° around the center axle O. In this manner, it is possible to determine the rotation position of the second wheel & pinion 43. Accordingly, the first light emitting element 61 is caused to stop the light emitting (Step S357), the second wheel & pinion 43 is rotated as much as 180°−θ (60° in the present embodiment) (Step S358), and the second second wheel transmittable portion 46 is moved to the second detection position. Subsequently, the reference pattern searching Step S330 and the second transmitted state searching Step S300 are completed. Through the above-described processes, the hand position detection operation is completed.

As described above, according to the present embodiment, there is provided the control unit 16 which detects the position of the second wheel & pinion 43 by causing the second light receiving element 65 to receive the light which is emitted from the second light emitting element 62 and which is transmitted through the first second wheel transmittable portion 45 or the second second wheel transmittable portion 46 belonging to the second wheel & pinion 43. Accordingly, it is possible to detect the position of the second hand 14 driven by the second wheel & pinion 43. Here, the second detection wheel 44 has the second detection wheel transmittable portion 47 through which the light transmitted through the first second wheel transmittable portion 45 or the second second wheel transmittable portion 46 of the second wheel & pinion 43 is transmittable. In addition, the control unit 16 causes the second light emitting element 62 to stop the light emitting, after the transmitting time point that the light is concurrently transmitted through the first second wheel transmittable portion 45 or the second second wheel transmittable portion 46 and the second detection wheel transmittable portion 47, and when the second detection wheel transmittable portion 47 is located at other positions except for the second detection position where the second detection wheel transmittable portion 47 is located at the transmitting time point. The second detection wheel transmittable portion 47 cannot transmit the transmitted light, when the second detection wheel transmittable portion 47 is located at other positions except for the second detection position. Accordingly, the second light emitting element 62 can be caused to stop the light emitting without affecting the detection of the position of the second wheel & pinion 43. Therefore, it is possible to reduce power consumption when the hand position is detected.

In addition, in the present embodiment, the first center wheel transmittable portion 35 and the second center wheel transmittable portion 36 are disposed in the center wheel & pinion 33. The first second wheel transmittable portion 45 and the second second wheel transmittable portion 46 are disposed in the second wheel & pinion 43 arranged coaxially with the center axle O of the center wheel & pinion 33. When the rotation position of the second wheel & pinion 43 is detected in order to detect the position of the second hand 14, the position of the second second wheel transmittable portion 46 disposed in the second wheel & pinion 43 is detected. In this case, while the second wheel & pinion 43 is rotated, the first light receiving element 64 or the second light receiving element 65 detects the light emitted from the first light emitting element 61 or the second light emitting element and transmitted through the first center wheel transmittable portion 35 or the second center wheel transmittable portion 36 of the center wheel & pinion 33 and the first second wheel transmittable portion 45 or the second second wheel transmittable portion 46 of the second wheel & pinion 43.

According to the present embodiment, the first second wheel transmittable portion 45 and the second second wheel transmittable portion 46 are formed so as to be asymmetric with each other with respect to the center axle O. Accordingly, the first light receiving element 64 or the second light receiving element 65 is caused to detect the light transmitted pattern (the desirable pattern and the reference pattern) corresponding to a shape, a position, and the number of the first second wheel transmittable portions 45 and the second second wheel transmittable portions 46. Therefore, it is possible to identify the second second wheel transmittable portion 46 in a state of distinguishing the second second wheel transmittable portion 46 from the first second wheel transmittable portion 45. In this manner, it is possible to detect the rotation position of the second wheel & pinion 43.

Moreover, in the present embodiment, in the first predetermined state where the center wheel & pinion 33 can transmit the light emitted from the first light emitting element 61 to the first light receiving element 64 in the first center wheel transmittable portion 35, the light emitted from the second light emitting element 62 is transmitted through the second center wheel transmittable portion 36 of the center wheel & pinion 33, and can be detected by the second light receiving element 65. Accordingly, the center wheel & pinion 33 is brought into the first predetermined state in order to detect the position of the second second wheel transmittable portion 46 disposed in the second wheel & pinion 43. Therefore, both the first light emitting element 61 and the first light receiving element 64, and both the second light emitting element 62 and the second light receiving element 65 can be used in detecting the position of the second second wheel transmittable portion 46. In this manner, the rotation position of the second wheel & pinion 43 is detected by detecting the position of the second second wheel transmittable portion 46 in any one of the first light receiving element 64 and the second light receiving element 65. Accordingly, compared to a case where the position of the second second wheel transmittable portion 46 is detected by one light receiving element, it is possible to shorten time required for detecting the position of the second second wheel transmittable portion 46. Therefore, it is possible to shorten time for operating the first light emitting element 61 and the second light emitting element 62, and thus, it is possible to reduce power consumption when the hand position is detected.

In addition, in the present embodiment, there is provided the second detection wheel 44 formed so as to be rotated once by causing the second stepping motor 22 to perform stepwise rotation driving the predetermined number of times N. The second detection wheel 44 has the second detection wheel transmittable portion 47 located at the position corresponding to the second second wheel transmittable portion 46, when the second second wheel transmittable portion 46 is located at the position corresponding to the second center wheel transmittable portion 36 of the center wheel & pinion 33 in the first predetermined state, when viewed in the axial direction. Therefore, in a state where the second detection wheel 44 is rotated and the second detection wheel transmittable portion 47 is located at other positions except for the position (second detection position) corresponding to the second center wheel transmittable portion 36 of the center wheel & pinion 33, the second detection wheel 44 blocks the light emitted from the second light emitting element 62.

According to the present embodiment, in the first predetermined state, the control unit 16 causes the second light emitting element 62 to emit the light, and performs the second detection wheel transmittable portion searching step for driving the second stepping motor 22 until the second light receiving element 65 receives the light emitted from the second light emitting element 62. Accordingly, it is possible to detect a state where the second detection wheel transmittable portion 47 is located at the position corresponding to the second center wheel transmittable portion 36 of the center wheel & pinion 33. Then, in the second detection wheel transmittable portion searching step, in a case where it is determined that the second light receiving element 65 receives the light emitted from the second light emitting element 62, when driving the second stepping motor 22, the control unit 16 causes the second stepping motor 22 to perform stepwise rotation driving as much as predetermined number of times N. While the second stepping motor 22 is driven, the control unit 16 causes the first light emitting element 61 and the second light emitting element 62 to stop the light emitting. In a state where the second detection wheel transmittable portion 47 is located at other positions except for the position corresponding to the second center wheel transmittable portion 36 of the center wheel & pinion 33, and where the light emitted from the second light emitting element 62 is blocked and the second light receiving element 65 cannot detect the light, the control unit 16 can cause the second light emitting element 62 to stop the light emitting. Therefore, it is possible to reduce power consumption when the hand position is detected.

In addition, when the rotation position of the center wheel & pinion 33 is detected in order to detect the position of the minute hand 13, for example, while the center wheel & pinion 33 is rotated, the first light receiving element 64 is caused to detect the light emitted from the first light emitting element 61 and transmitted through the first center wheel transmittable portion 35 or the second center wheel transmittable portion 36 and the first second wheel transmittable portion 45 or the second second wheel transmittable portion 46. Depending on the rotation angle of the center wheel & pinion 33 for one step of the first stepping motor 21, in order to cause the first center wheel transmittable portion 35 or the second center wheel transmittable portion 36 located at the first detection position to completely retreat from the first detection position, it is necessary to rotate the first stepping motor 21 several steps in some cases.

In the present embodiment, the minute detection wheel transmittable portion 37 belonging to the minute detection wheel 34 is disposed at the position corresponding to the first center wheel transmittable portion 35 when viewed in the axial direction, in the first predetermined state where the center wheel & pinion 33 can transmit the light emitted from the first light emitting element 61 to the first light receiving element 64 in the first center wheel transmittable portion 35. In addition, the minute detection wheel transmittable portion 37 is disposed at the position corresponding to the second center wheel transmittable portion 36 when viewed in the axial direction, in the second predetermined state where the center wheel & pinion 33 can transmit the light emitted from the first light emitting element 61 to the first light receiving element 64 in the second center wheel transmittable portion 36. The rotation angle of the minute detection wheel 34 for one step of the first stepping motor 21 can become larger than the rotation angle of the center wheel & pinion 33 by setting the gear ratio of the center wheel & pinion 33 with respect to the minute detection wheel 34 to be smaller than one. In this manner, the minute detection wheel transmittable portion 37 located at the first detection position can be caused to completely retreat from the first detection position by rotating the first stepping motor 21 one step. Accordingly, even in a case where it is necessary to rotate the first stepping motor 21 several steps in order to cause the first center wheel transmittable portion 35 or the second center wheel transmittable portion 36 located at the first detection position to completely retreat from the first detection position, it is possible to block the light emitted from the first light emitting element 61 in the region other than the minute detection wheel transmittable portion 37 of the minute detection wheel 34. Accordingly, one step of the first stepping motor 21 enables the first light receiving element 64 to be shifted between a state where the light emitted from the first light emitting element 61 can be detected and a state where the light cannot be detected. Therefore, it is possible to reliably detect the rotation position of the center wheel & pinion 33 in response to the position detection of the minute hand 13.

In addition, a pair of the first second wheel transmittable portions 45 are disposed so as to be symmetric with each other with respect to the center axle O. Accordingly, the second second wheel transmittable portion 46 is disposed in one region within regions between a pair of the first second wheel transmittable portions 45 in the circumferential direction of the second wheel & pinion 43. Therefore, after the control unit 16 determines that any one of the first light receiving element 64 and the second light receiving element 65 detects the desirable pattern indicating that the first second wheel transmittable portion 45 passes in the desirable pattern determination Step S323 and the light receiving element determination Step S331, the control unit 16 determines whether or not the light receiving element detecting the desirable pattern detects the reference pattern indicating that the second second wheel transmittable portion 46 passes in the first reference pattern determination Step S340 or the second reference pattern determination Step S350. In this manner, the first light receiving element 64 or the second light receiving element 65 does not need to directly detect the light transmitted through the second second wheel transmittable portion 46, and the position of the second second wheel transmittable portion 46 can be detected. Accordingly, it is possible to efficiently detect the position of the second second wheel transmittable portion 46. Therefore, it is possible to shorten time for operating the first light emitting element 61 and the second light emitting element 62, and thus, it is possible to reduce power consumption when the hand position is detected.

In addition, in the present embodiment, the control unit 16 causes the second light emitting element 62 to stop the light emitting after the first reference pattern determination Step S340 is completed, and causes the first light emitting element 61 to stop the light emitting after the second reference pattern determination Step S350 is completed. After the first reference pattern determination Step S340 and the second reference pattern determination Step S350 are completed, the position of the second second wheel transmittable portion 46 is completely detected. Accordingly, power consumption can be reduced by causing the first light emitting element 61 or the second light emitting element 62 to stop the light emitting.

The electronic timepiece 1 according to the present embodiment includes the above-described movement 10. Therefore, it is possible to reduce power consumption when the hand position is detected.

The invention is not limited to the embodiment described above with reference to the drawings, and various modification examples are conceivable within the technical scope of the invention.

For example, in the above-described embodiment, each transmittable portion disposed in each gear body is disposed by forming the through-hole in the gear body, but the configuration is not limited thereto. For example, each transmittable portion may be disposed in such a way that each gear body is formed using a light-transmitting member and other regions except for each transmittable portion are coated with a light-blocking coating material.

In addition, in the above-described embodiment, the central angle θ between the first center wheel transmittable portion 35 and the second center wheel transmittable portion 36 of the center wheel & pinion 33 is set to 120°, but the configuration is not limited thereto. The central angle θ between the first center wheel transmittable portion 35 and the second center wheel transmittable portion 36 may be appropriately set within a range larger than 0° and smaller than 180°.

In addition, in the above-described embodiment, each transmittable portion is the circular through-hole except for the first second wheel transmittable portion 45, but the configuration is not limited thereto. For example, the through-hole may be a square hole or the like.

In addition, in the above-described embodiment, the first second wheel transmittable portion 45 is the long hole, but the configuration is not limited thereto. The first second wheel transmittable portion and the second second wheel transmittable portion may be formed so as to be asymmetric with each other with respect to the center axle O. In addition, the end portion of the first second wheel transmittable portion may have an arcuate shape instead of a rectangular shape. In this case, the end portion has a shape in accordance with an emitting shape of the light emitted from the light emitting element. Therefore, the end portion of the long hole can also reliably detect whether or not the light is received.

In addition, in the above-described embodiment, the gear ratio of the center wheel & pinion 33 with respect to the minute detection wheel 34 is set to 1/30, but the configuration is not limited thereto. The gear ratio of the center wheel & pinion with respect to the minute detection wheel may be set to 1/integer.

In addition, in the above-described embodiment, the gear ratio of the second wheel & pinion 43 with respect to the second detection wheel 44 is set to 1/24, but the configuration is not limited thereto. The gear ratio of the second wheel & pinion with respect to the second detection wheel may be set to 1/integer.

In addition, in the above-described embodiment, the desirable pattern is set to "detection-detection-no detection-no detection" and the reference pattern is set to "detection", but the configuration is not limited thereto. For example, the desirable pattern may be set to "detection-detection-no detection" and the reference pattern may be set to "no detection-detection".

Alternatively, within the scope not departing from the gist of the invention, configuration elements in the above-described embodiment can be appropriately replaced with known configuration elements.

What is claimed is:

1. A movement comprising:

a light emitting element for emitting light;

a light receiving element that is arranged to receive light emitted from the light emitting element;

a gear that is rotated by a drive source to drive an indicating hand, and that has a transmittable portion through which the light is transmittable;

a detecting gear that has a transmittable portion for detection through which the light is transmittable, and whose rotational frequency per predetermined time is set to be faster than that of the gear; and a control unit configured to: detect a position of the gear by causing the light receiving element to receive the light which is emitted from the light emitting element and which is transmitted through the transmittable portion, detect a transmitting time point that the light is concurrently transmitted through the transmittable portion and the transmittable portion for detection, cause the light emitting element to stop light emitting during an interval that begins at the time point when the light receiving element detects light transmitted through the transmittable portion, and vary the interval in accordance with the rotational frequency of the detecting gear.

2. The movement according to claim 1, further comprising:

a first gear that is rotated by power of a first drive source so as to drive a first indicating hand;

a second gear serving as the gear that is arranged coaxially with a center axle of the first gear, and that is rotated by power of a second drive source functioning as the drive source so as to drive a second indicating hand serving as the indicating hand;

a first position detecting gear that is arranged so as to overlap a portion of the second gear when viewed in an axial direction of the center axle, and that serves as the detecting gear rotated by power of the second drive source;

a first light emitting element and a second light emitting element functioning as the light emitting element, which are arranged on one side in the axial direction with respect to the first gear and the second gear;

a first light receiving element that is disposed on the other side in the axial direction across the first gear and the second gear so as to detect the light emitted from the first light emitting element;

a second light receiving element functioning as the light receiving element that is disposed on the other side in the axial direction across the first gear and the second gear so as to detect the light emitted from the second light emitting element; and the control unit that controls driving of the first drive source and the second drive source, and that detects the light received by the first light receiving element and the second light receiving element so as to control the light emitting of the first light emitting element and the second light emitting element, wherein the first gear has a first transmittable portion through which the light emitted from the first light emitting element and the second light emitting element is transmittable, and a second transmittable portion which is disposed on a rotation trajectory of the first transmittable portion, and through which the light emitted from the first light emitting element and the second light emitting element is transmittable, wherein the second gear has a third transmittable portion and a fourth transmittable portion, which function as the transmittable portion, which are disposed on the rotation trajectory of the first transmittable portion when viewed in the axial direction, through which the light emitted from the first light emitting element and the second light emitting element is transmittable, and which are formed so as to be asymmetric with each other with respect to the center axle, wherein the first position detecting gear has a fifth transmittable portion functioning as the transmittable portion for detection through which the light emitted from the second light emitting element is transmittable, and is formed so as to be rotated once by causing the second drive source to perform stepwise rotation driving a predetermined number of times, wherein in a first predetermined state where the first gear can transmit the light emitted from the first light emitting element to the first light receiving element in the first transmittable portion, the second light receiving element is disposed so as to be capable of detecting the light transmitted through the second transmittable portion and emitted from the second light emitting element, wherein the fifth transmittable portion is disposed to be located at a position corresponding to the fourth transmittable portion, when the fourth transmittable portion is located at a position corresponding to the second transmittable portion of the first gear in the first predetermined state, when viewed in the axial direction, wherein in the first predetermined state, the control unit causes the second light emitting element to emit the light, and performs a fifth transmittable portion searching step of driving the second drive source until the second light receiving element receives the light emitted from the second light emitting element, and wherein in a case where the control unit determines that the second light receiving element receives the light emitted from the second light emitting element in the fifth transmittable portion searching step, when the control unit drives the second drive source, the control unit causes the second drive source to perform stepwise rotation driving per predetermined number of times, and the control unit causes the first light emitting element and the second light emitting element to stop light emitting while the second drive source is driven.

3. The movement according to claim 2, further comprising:

a second position detecting gear that is arranged between the first light emitting element and the first light receiving element in the axial direction, and that is rotated by power of the first drive source, wherein the second position detecting gear has a sixth transmittable portion through which the light emitted from the first light emitting element is transmittable, and wherein in the first predetermined state, the sixth transmittable portion is disposed so as to be located at a position corresponding to the first transmittable portion when viewed in the axial direction, and in a second predetermined state where the first gear can transmit the light emitted from the first light emitting element to the first light receiving element in the second transmittable portion, the sixth transmittable portion is disposed so as to be located at a position corresponding to the second transmittable portion when viewed in the axial direction.

4. The movement according to claim 2, wherein a pair of the third transmittable portions are disposed so as to be symmetric with each other with respect to the center axle, and wherein the control unit is configured to perform:

a first determination step of determining whether or not any one of the first light receiving element and the second light receiving element detects a first pattern indicating that the third transmittable portion passes through a position corresponding to the second transmittable portion when viewed in the axial direction, in a case where the control unit determines that the second light receiving element receives the light emitted from the second light emitting element in the fifth transmittable portion searching step, a second determination step of determining whether or not the second light receiving element detects the first pattern, in a case where the control unit determines that any one of the first light receiving element and the second light receiving element detects the first pattern in the first determination step, a third determination step of causing the second drive source to perform the stepwise rotation driving at least a predetermined number of times in a case where the control unit determines that the second light receiving element detects the first pattern in the second determination step, and determining whether or not the second light receiving element detects a second pattern indicating that the fourth transmittable portion passes through a position corresponding to the second transmittable portion when viewed in the axial direction, and a fourth determination step of causing the second drive source to perform the stepwise rotation driving at least a predetermined number of times in a case where the control unit determines that the second light receiving element does not detect the first pattern in the second determination step, and determining whether or not the first light receiving element detects the second pattern.

5. An electronic timepiece comprising:

the movement according to claim 1; and a solar panel that generates power to be supplied to the drive source.

* * * * *